US006729260B2

(12) United States Patent
Elvestad

(10) Patent No.: US 6,729,260 B2
(45) Date of Patent: May 4, 2004

(54) LIGHTWEIGHT COLLAPSIBLE BOAT

(76) Inventor: Alf J. Elvestad, P.O. Box 700, Enfield, NH (US) 03748

( * ) Notice: Subject to any disclaimer, the term of this patent is extended or adjusted under 35 U.S.C. 154(b) by 8 days.

(21) Appl. No.: 10/114,135

(22) Filed: Apr. 1, 2002

(65) Prior Publication Data

US 2003/0101921 A1 Jun. 5, 2003

Related U.S. Application Data

(60) Provisional application No. 60/338,560, filed on Dec. 4, 2001.

(51) Int. Cl.[7] ..... B63B 7/00
(52) U.S. Cl. ..... 114/354
(58) Field of Search ..... 114/347, 352–354

(56) References Cited

U.S. PATENT DOCUMENTS 2,120,332 A * 6/1938 Jackson ..... 114/354
5,826,532 A 10/1998 Elvestad ..... 114/347
5,868,096 A 2/1999 Elvestad ..... 114/347
5,915,327 A 6/1999 Elvestad ..... 114/347
6,314,904 B1 11/2001 Elvestad ..... 114/347

* cited by examiner

*Primary Examiner*—Edwin Swinehart
(74) *Attorney, Agent, or Firm*—Michael J. Weins; Jeffrey E. Semprebon

(57) ABSTRACT

A collapsible boat has a frame covered by a hull skin, the frame having two gunwales and a keel stringer terminating at two stem elements. The ends of the gunwales can be secured to the corresponding stem element by end connectors that connect to the stem element and are held by skin tension. Alternatively, the hull skin can secure the gunwale ends to the corresponding stem element, the gunwales residing in closed-ended gunwale sleeves and the hull skin being configured to secure the gunwale ends together and prevent upwards motion of the stem element. The closed ends can be openable to install the gunwales. To tension the hull skin over the frame, the keel stringer can have a central joint to allow installation in a bent configuration. The keel stringer is straightened during assembly to increase its effective length, causing the stem elements to forcibly engage the hull skin.

22 Claims, 15 Drawing Sheets

LIGHTWEIGHT COLLAPSIBLE BOAT

This application claims the benefit of Provisional application No. 60/338,560 filed Dec. 4, 2001.

FIELD OF THE INVENTION

The present invention is for a collapsible boat which is extremely lightweight and easy to assemble. The collapsible boat has particular utility for use as a kayak.

BACKGROUND OF THE INVENTION

Collapsible boats such as canoes and kayaks have classically had a frame which supports a skin which forms the hull of the boat. The skin is frequently loosely fitted over the frame, and then tensioned over the frame by inflatable chambers either contained in the skin or positioned between the skin and the frame. When the chambers are inflated by the user, the skin is tightened over the frame to provide rigidity to the resulting boat.

In the case of folding kayaks, the skin is formed with a deck which limits the ability to fit the skin over the frame, since the skin completely surrounds the frame at the ends. In such case, the frame is typically formed in two halves which are inserted into the skin and then assembled together. In some designs, the connection of the frame halves together also serves to expand the frame longitudinally, providing some degree of tension against the skin.

The use of an independent, free-standing frame complicates the structure of the boat and increases weight. In the case of canoes, which typically lack decks, it has been found advantageous to employ the tension of the skin to secure the frame elements together. Such boats are taught in U.S. Pat. Nos. 5,915,327 and 6,314,904, by the inventor of the present invention. These boats employ a frame having a telescoping keel stringer, and the frame is expanded longitudinally by the action of supplemental stringers. The supplemental stringers forcibly engage the telescoping keel stringer at each end and increase the effective length of the telescoping keel stringer as the supplemental stringers are fitted into position with respect to the other elements of the frame. The increased length of the telescoping keel stringer acts to tension the frame against the skin longitudinally. Further tensioning of the skin over the frame is provided by inflatable compartments. While such boats have achieved significant reductions in weight, further simplification of the frame structure would be advantageous to further reduce weight and to facilitate fabrication. Additionally, the end structure employed in these boats limits the shape of the ends to a relatively broad curve, limiting the visual appearance of the resulting boat and making fitting a deck to the boat for use as a kayak problematic.

Thus, there is a need for a collapsible boat having reduced weight and a simplified structure. There is also a need for a lightweight collapsible boat which is suitable for use as a kayak.

SUMMARY OF THE INVENTION

The collapsible boat of the present invention has a frame which is covered by a hull skin. The frame includes a pair of gunwales, each having a gunwale first end and a gunwale second end, and a series of ribs, each of which is attached to the gunwales by gunwale-engaging clips. The frame also includes a keel stringer, which terminates at a first stem element and a second stem element. The first stem element terminates at a first stem element end, while the second stem element terminates at a second stem element end.

Preferably, the gunwales and the keel stringer are each formed of multiple pieces of tubing, slidably connectable and maintained together with shock cord in the manner known in the art for forming collapsible tubular members. The ribs are preferably each formed of a single piece of tubing. The keel stringer has rib-engaging clips affixed thereto, to which a central portion of each of the ribs can be lockably engaged. Preferably, each rib has a clip-engaging attachment designed to lockably mate with one of the rib-engaging clips of the keel stringer. Such rib-engaging clips and clip-engaging attachments are described in U.S. Pat. No. 6,314,904 of the present inventor, incorporated herein by reference.

Means are provided for securing the gunwale first ends with respect to the first stem element end and for securing the gunwale second ends with respect to the second stem element end. These means complete the formation of the frame and, when longitudinal tension of the frame against the hull skin is provided, these means allow such longitudinal tension to secure the various elements of the frame together.

One aspect of the present invention resides in a preferred structure for securing the gunwale first ends with respect to the first stem element end. With this preferred structure, each of the gunwale first ends has a first end connector which is connectable to the first stem element end. Preferably, the first end connectors are freely movable into engagement with the first stem element end from above, and the first stem element end supportably engages the first end connectors to prevent further upwards motion of the first stem element with respect to the gunwale first ends.

The connection of the gunwale first ends to the first stem element end can be facilitated by the use of a first bracket attached to the first stem element end, in which case the first end connectors are designed to be connectable with the first bracket. In a preferred embodiment, the first bracket has a pair of upwardly-opening slots and the first end connectors are formed by bolts with shanks sized to slidably engage each of the slots, while the heads of the bolts are sized to retain the bolts in the slots.

Alternatively, the first stem element end can be directly engaged by the first end connectors on the gunwale first ends. In one preferred embodiment, the first stem element end has an opening, and the first end connectors are formed with pins which are insertable into the opening.

A similar structure can be employed for securing the gunwale second ends with respect to the second stem element end, in which case the gunwale second ends each have a second end connector thereon which is connectable to the second stem element end.

The hull skin of the collapsible boat has a pair of gunwale sleeves which slidably engage the gunwales of the frame. The hull skin also has a pair of side panels attached to the gunwale sleeves, and a bottom panel attached to the side panels. The side panels and the bottom panel are configured to secure the side panels to each other at the ends of the boat. Preferably, the bottom panel has bottom panel extensions at each end to which the side panels are attached, the bottom panel extensions forming the regions of the hull skin which overlie the first and second stem elements.

Another aspect of the present invention resides in the optional use of the hull skin to secure the gunwale ends to the corresponding stem element end at one or both ends of the collapsible boat, this option being discussed hereinafter in terms of the gunwale second ends and the second stem element end. When this option is employed, the means for securing the gunwale second ends is provided by closed sleeve ends on the gunwale sleeves in combination with means associated with the hull skin for securing the gunwale second ends together and preventing upwards motion of the second stem element end. The closed sleeve ends of the gunwale sleeves limit the longitudinal position of the gunwales with respect the gunwale sleeves by blocking motion of the gunwales when the gunwale second ends are engaged with the closed sleeve ends. Preferably, the gunwale second ends are engaged by the closed ends when at a position where they reside in close proximity to the second stem element end after the frame is assembled. The means for securing the gunwale second ends together and for preventing upwards motion of the second stem element end act both to maintain the gunwale second ends in close proximity to each other and to limit any upward motion of the second stem element end. The use of the closed sleeve ends serves to provide greater accuracy in alignment between the frame and the hull skin, and can be employed in collapsible boats having various means for securing the gunwale first ends with respect to the first stem element end.

The closed ends of the gunwale sleeves can be made permanently closed, such as by sewing or, as discussed in greater detail below, by use of a fastener to secure the fabric of each of the gunwale sleeves together to close the ends.

Alternatively, the closed ends can be provided by an openable closure element associated with each gunwale sleeve which can close the end of the sleeve when secured, but which can be opened to allow slidable engagement between the gunwale and the gunwale sleeve. Having at least the closed ends of the gunwale sleeves openable at one or both ends of the boat allows the use of this aspect of the present invention at both ends of the boat, since the gunwale sleeves can be opened at one end to allow the gunwale sleeves to be inserted therein, and thereafter closed to limit the position of the gunwales. In one preferred embodiment, each gunwale sleeve is provided with a closure flap which extends over the end of the gunwale sleeve and is securable to the gunwale sleeve to close the end. The engagement of the flap with the gunwale end limits the position of the gunwale with respect to the gunwale sleeve.

In one preferred embodiment employing the closed sleeve ends, the means for securing the gunwale second ends together and preventing upwards motion of the second stem element end is provided by a cross strap that is attached to the hull skin and extends over the gunwale sleeves in the vicinity of the closed sleeve ends. The cross strap secures the gunwale second ends together when the gunwale second ends are positioned at the closed sleeve ends of the gunwale sleeves. The closed sleeve ends of the gunwale sleeves in this embodiment are positioned such as to place the gunwale second ends above the second stem element end when the collapsible boat is assembled. Thus, the gunwale second ends are positioned to engage the second stem element end (through the fabric of the gunwale sleeves) to limit any upwards motion of the second stem element end. Since tension of the frame against the hull skin creates an upwards force on the second stem element, the skin tension causes the second stem element end to forcibly engage the gunwale second ends so as to be secured with respect thereto.

In another preferred embodiment employing the closed sleeve ends, the means for securing the gunwale second ends together and for preventing upwards motion of the second stem element end are provided by a fold in the hull skin in close proximity to the closed sleeve ends of the gunwale sleeves in combination with a fastener that secures the fold in the hull skin together. By securing the fold together, the fastener secures the closed sleeve ends of the gunwale sleeves together and thus acts to secure the gunwale second ends together. As noted above, when the closed ends of the gunwale sleeves are to be permanently closed, the fastener can also serve to provide the closed ends of the gunwale sleeves by securing the fabric of the gunwale sleeves together. When a fold in the hull skin secured by a fastener is employed, the fastener also acts to form a pocket into which the second stem element end seats to prevent upwards motion of the second stem element end. Again, skin tension creates an upwards force on the second stem element, and in this embodiment causes the second stem element end to forcibly engage the pocket so as to be secured therein. Thus, in this embodiment the gunwale second ends are secured with respect to the second stem element end via the hull skin.

Means for longitudinally tensioning the hull skin with respect to the frame are provided. The tension of the hull skin maintains the gunwales engaged with the gunwale-engaging clips on the ribs, and typically also respectively maintains the gunwale first ends and the gunwale second ends secured with respect to the first stem element end and the second stem element end. One means for longitudinally tensioning the hull skin with respect to the frame is to employ a telescoping keel stringer in combination with supplemental stringers which act to lengthen the telescoping keel stringer as the supplemental stringers are moved into position, such as taught in the '904 patent.

However, another aspect of the present invention provides a simpler structure for longitudinally tensioning the hull skin with respect to the frame, which eliminates the requirement for supplemental stringers and the structure required to connect the supplemental stringers to the telescoping keel stringer at each end. The collapsible boat with this simplified structure uses the keel stringer to longitudinally tension the hull skin against the frame. This improved structure for longitudinally tensioning the hull skin with respect to the frame can be used with the structures discussed above for securing the gunwale ends with respect to the stem elements, or with the structures for securing the gunwale ends employed in earlier collapsible boats, such as are taught in the '904 patent and U.S. Pat. No. 5,915,327, also incorporated herein by reference. In all cases, the keel stringer is formed with a joint spaced apart from the first stem element and the second stem element so as to reside in a central region of the collapsible boat, hereinafter referred to as a central joint. When the keel stringer is formed of multiple sections of tubing, the central joint can be readily provided between two of the sections. The keel stringer is installed while in a bent configuration where the sections of the keel stringer on either side of the central joint are substantially inclined with respect to each other. After installation in its bent configuration, the keel stringer can be straightened to increase its effective length in order to longitudinally tension the hull skin.

When the keel stringer is installed in its bent configuration, the gunwale first ends can be secured with respect to the first stem element end without resistance due to skin tension. For example, when the collapsible boat employs a first bracket on the first stem element end as discussed above, the first end connectors of each of the gunwales can be readily connected to the first bracket on the first stem element while the keel stringer is in its bent configuration. Similarly, when the means for securing the gunwale second ends is provided by the frame of the collapsible boat, the gunwale second ends can readily be secured with respect to the second stem element end while the keel stringer is in its bent configuration. In the alternative case, where the gunwale second ends are secured with respect to the second stem element end by employing closed sleeve ends on the gunwale sleeves, the second stem element end can be positioned with respect to the hull skin and the gunwale second ends so as to become secured with respect thereto when the keel stringer longitudinally tensions the hull skin.

After the stem elements have been positioned for securing to their respective gunwale ends, one of the ribs, which is located at or near the center of the collapsible boat and is hereinafter referred to as a central rib, is connected to the gunwales. The keel stringer is then moved to a substantially straight configuration where the sections of the keel stringer on either side of the central joint are substantially aligned. The keel stringer is also moved to a central location, where it can lockably engage the central rib at a point near the central joint. It should be appreciated that, when the keel stringer is first placed into its substantially straight configuration, its effective length is typically limited by tension from the skin, which maintains the keel stringer bowed at a somewhat reduced length. As additional ribs are installed and lockably engaged with the keel stringer, the keel stringer is increasingly forced into a straight configuration, increasing its effective length. The increased length of the keel stringer as it is moved from its bent to its substantially straight configuration and then brought to its straight configuration causes the stem elements and the gunwales to forcibly engage the hull skin, thereby tensioning the hull skin longitudinally against the frame.

In one preferred embodiment, the central joint is formed between two adjacent sections of the keel stringer, one of which is provided with an insertable section. The insertable section of the central joint is inserted into the adjacent section of the keel stringer to place the keel stringer in its substantially straight configuration. The insertable section preferably has a rounded profile, which allows the user to readily insert the insertable section into the adjacent section of the keel stringer while the keel stringer is in its bent configuration.

The use of the jointed keel stringer discussed above greatly simplifies the structure of the collapsible boat. This simplified structure decreases the cost of fabrication, facilitates assembly and disassembly of the boat, and reduces the size and weight of the boat when the boat is collapsed for storage and/or transport. This structure also reduces the area of the hull skin which is subjected to significant abrasion.

While the longitudinal tension of the hull skin over the frame is typically sufficient to maintain the elements of the frame secured with respect to each other, it is preferred to also provide transverse tension of the hull skin over the frame to provide increased rigidity for the collapsible boat. Such transverse tension can be provided by a pair of inflatable compartments which reside between the side panels of the hull skin and the frame when the collapsible boat is assembled. When inflated, the inflatable compartments maintain the hull skin tautly in place on the frame such that the frame and the hull skin act together to form a self-supporting structure. The transverse tension acts to further secure the elements of the frame to each other to allow use of the collapsible boat in rough water conditions. When the inflatable compartments are deflated, the hull skin more loosely engages the frame to facilitate assembly and disassembly.

When the frame of the collapsible boat employs a single keel stringer with a central hinge as discussed above, the inflatable compartments are also preferably sized and configured to provide a smooth contour of the hull skin with respect to the ribs of the frame.

When the boat is to be used as a kayak, it has a first deck support member which attaches to the frame such that the first deck support member extends parallel to the ribs. A first deck stringer is also provided, having a first deck stringer inner end region, which is configured to engage the first deck support member, and a first deck stringer outer end region, which is configured to reside above said gunwale first ends. Means are provided for securing the first deck stringer outer end region with respect to the gunwale first ends, these means being associated with the hull skin. Similarly, a second deck support member attached to the frame so as to extend parallel to the series of ribs, and a second deck stringer is provided which has a second deck stringer inner end region, which engages the second deck support member, and a second deck stringer outer end region, which resides above said gunwale second ends. Means are provided for securing the second deck stringer outer end region with respect to the gunwale second ends, these means again being associated with the hull skin.

A deck skin is provided to extend over the frame to close the top region of the hull skin, and is supported over the first deck support member, the first deck stringer, the second deck support member, and the second deck stringer. These elements preferably maintain the deck skin in a convex or peaked configuration to prevent pooling of water thereon. The deck skin attaches to the hull skin below the gunwales, preferably by snaps or hook-and-loop fasteners. The deck has a cockpit opening located in a central region to allow a user to sit in the collapsible boat.

The first deck support member and the second deck support member can be attached either directly to the gunwales or to one of the ribs in close proximity to the gunwale-engaging clips. Alternatively, the first deck support member and the second deck support member could each be made an integral part of one of the ribs.

Preferably, the hull skin is formed with a first hull skin extension, which extends over the first deck stringer outer end region, and a first deck support strap is attached to the first hull skin extension. The first deck support strap connects the first hull skin extension with respect to the first deck support member, thereby forcibly engaging the first deck stringer outer end region against the gunwale first ends to provide the means for securing the first deck stringer outer end region. A second hull skin extension and a second deck support strap can be similarly employed to provide the means for securing the second deck stringer outer end region with respect to the gunwale second ends. When the bottom panel of the hull skin is provided with bottom panel extensions to which the side panels are attached, the bottom panel extensions can be lengthened to provide the first hull skin extension and the second hull skin extension.

The cockpit opening of the deck skin is preferably surrounded by a raised coaming to deflect water away from the cockpit opening and to allow the user to attach a spray skirt to seal the cockpit opening. In one preferred embodiment, the deck skin is provided with a coaming sleeve which surrounds the cockpit opening, and a tubular coaming member resides in the coaming sleeve. The tubular coaming member can be formed as a two-part structure of aluminum tubing, the two parts being connected together by hinges to allow the tubular coaming member to be folded. The coaming sleeve is preferably formed of an elastic fabric such as neoprene to prevent wrinkling and provide a smoother appearance for the raised coaming.

To provide increased internal space in the collapsible boat, it is preferred to employ longitudinal members which limit the expansion of the inflatable compartments in the spaces between the ribs. Such can be accomplished over the length of the collapsible boat, through use of side stringers which are supported on the ribs, or by side rods connected between desired ribs to limit expansion of the inflatable compartments therebetween.

A boat seat is preferably provided, which can be attached with respect to one or more of the ribs of the frame to maintain the boat seat in position longitudinally. In a preferred embodiment, the boat seat has a seat portion, formed of a first series of inflatable chambers attached to a seat support structure that provides longitudinal rigidity to the seat portion. Preferably, the seat support structure is formed by relatively rigid foam pads which rest on the bottom panel of the hull skin and are positioned on either side of the keel stringer when the boat seat is installed. The foam pads raise the first series of inflatable chambers of the seat portion above the keel stringer for the comfort of the user. The boat seat also has a back portion, formed of a second series of inflatable chambers attached to a back support structure. The seat portion and the back portion are connected together by a fabric hinge, and straps are provided on either side to adjustably limit the rotation of the back portion relative to the seat portion. The straps can also serve to anchor the boat seat to one or more of the ribs to further stabilize the seat with respect to the frame.

To provide leg bracing for the user, particularly when the collapsible boat is used as a kayak, brace straps can be added along the sides forward of the seat. The brace straps should be loose enough to allow the user to readily force their knees thereunder, while being tight enough to provide resistance to allow the user's legs to become forcibly engaged with respect to the collapsible boat. Such brace straps are known in the art, and are frequently employed in kayaks which are designed for the user to sit atop the deck.

BRIEF DESCRIPTION OF THE FIGURES

FIG. 3 shows the keel stringer when an insertable section on one section of the keel stringer is positioned to engage an open end of an adjacent section of the keel stringer. The keel stringer is in a bent configuration where the sections of the keel stringer are substantially inclined to each other.

FIG. 18 shows the closure flaps secured to close the sleeve ends.

BEST MODE OF CARRYING THE INVENTION INTO PRACTICE

Figure 1:
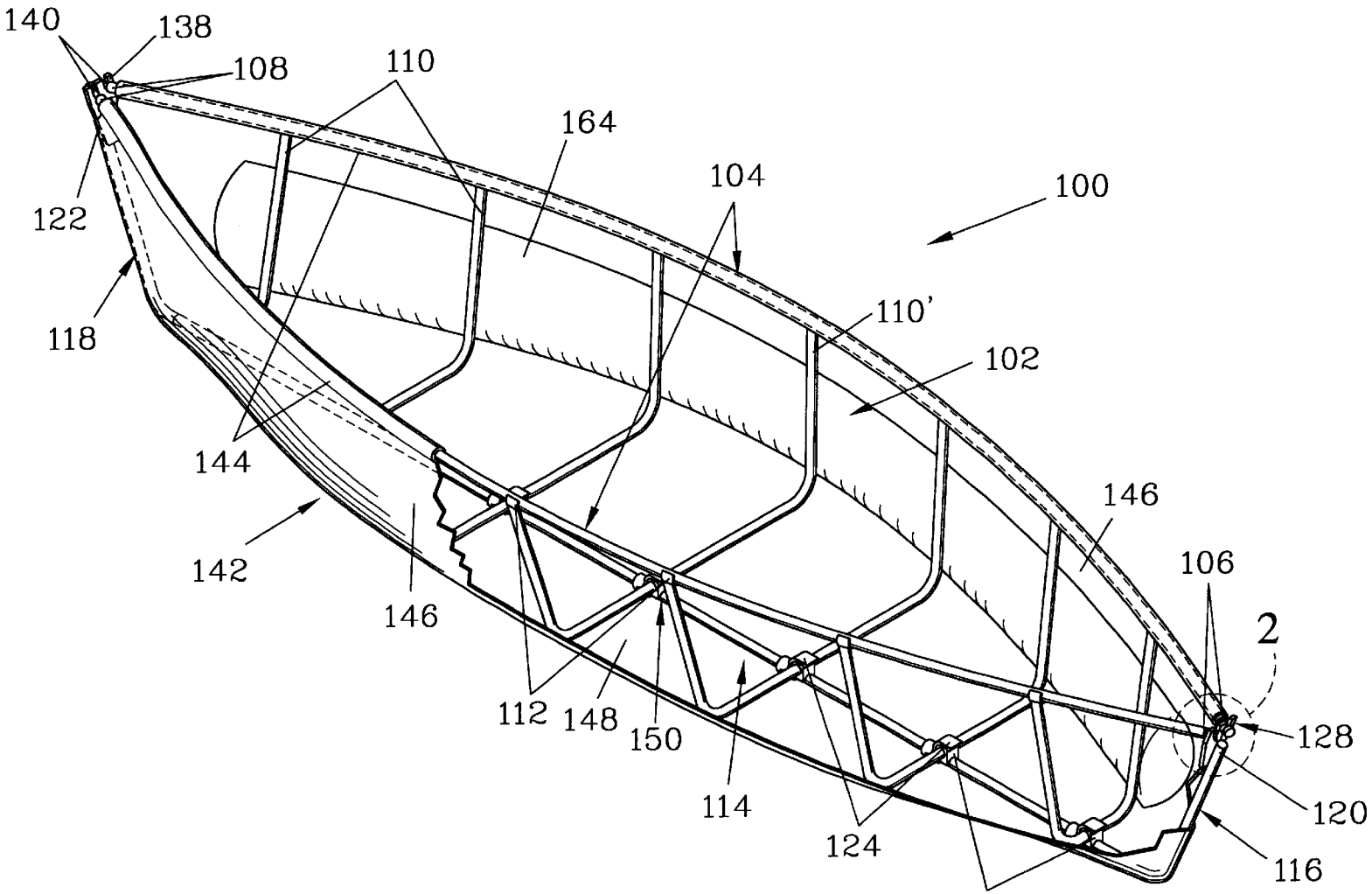
FIG. 1 is an isometric view of a collapsible boat which forms one embodiment of the present invention. The collapsible boat has a frame covered by a hull skin, which is shown partially broken away. The frame has gunwales which have end connectors on both ends, the end connectors engaging brackets on a first stem element and a second stem element.

FIG. 1 is an isometric view of a collapsible boat 100 which forms one embodiment of the present invention. The collapsible boat 100 has a frame 102 that includes a pair of gunwales 104, each having a gunwale first end 106 and a gunwale second end 108. The frame 102 also has a series of ribs 110, each of which is attached to the gunwales 104 by gunwale-engaging clips 112. The frame 102 also includes a keel stringer 114 that terminates at a first stem element 116 and a second stem element 118 (shown in hidden lines). The first stem element 116 terminates at a first stem element end 120, while the second stem element 118 terminates at a second stem element end 122. The keel stringer 114 has rib-engaging clips 124 affixed thereon, and each of the ribs 110 preferably has a clip-engaging attachment 126 centrally positioned thereon that is designed to lockably mate with a corresponding one of the rib-engaging clips 124 on the keel stringer 114. Such rib-engaging clips 124 and clip-engaging attachments 126 are described in U.S. Pat. No. 6,314,904 of the present inventor, incorporated herein by reference.

The frame 102 differs from those of earlier collapsible boats in part in the means employed for securing the gunwale first ends 106 with respect to the first stem element end 120 and the gunwale second ends 108 with respect to the second stem element end 122. In this embodiment, both of these means are incorporated into the frame 102 and constitute one aspect of the present invention. In the collapsible boat 100, the first stem element end 120 is fitted with a first bracket 128, which is better shown in the detail view of FIG. 2. The first bracket 128 is preferably affixed to the first stem element end 120. The first bracket 128 has a pair of upwardly-opening slots 130. Each of the gunwale first ends 106 has a first end connector 132 mounted thereon, which is designed to be connectable to the first bracket 128. In this embodiment, the first end connectors 132 are formed as bolts having shanks 134 and heads 136. The shanks 134 are sized to slidably engage the slots 130, while the heads 136 are sized to prevent the first end connectors 132 from moving longitudinally out of the slots 130. Since the slots 130 open upwardly, shanks 134 of the first end connectors 132 can be readily engaged with or disengaged from the slots 130 from above, while the first bracket 128 supportably engages the first end connectors 132 to prevent upwards motion of the first stem element 116 with respect to the gunwale first ends 106.

The use of the first bracket 128 and the first end connectors 132 to secure the gunwale first ends 106 to the first stem element end 120 allows the gunwales 104 to meet at an acute angle, rather than being joined by a U-shaped gunwale terminator as employed in earlier collapsible boats. The angled contour of the resulting structure provides a more aggressive appearance for the collapsible boat 100, and facilitates fabricating a cover for the end portion of the collapsible boat 100.

Similarly, referring again to FIG. 1, the means for securing the gunwale second ends 108 with respect to the second stem element end 122 in this embodiment is provided by a second bracket 138 affixed to the second stem element end 122, in combination with second end connectors 140 on the gunwale second ends 108. The second end connectors 140 engage the second bracket 138 in the same manner as the first end connectors 132 and the first bracket 128 discussed above, and the engagement of the second end connectors 140 with the second bracket 138 serves to limit upwards motion of the second stem element 118.

The collapsible boat 100 has a hull skin 142 which covers the frame 102 to form the hull of the collapsible boat 100. Additionally, tension of the hull skin 142 over the frame 102 serves to secure the various elements of the frame 102 together, as discussed in greater detail below.

The hull skin 142 of this embodiment shares many features in common with the hull skins of earlier collapsible boats. The hull skin 142 has a pair of gunwale sleeves 144 which are slidably engaged by the gunwales 104 of the frame 102. The hull skin 142 has a pair of side panels 146 attached to the gunwale sleeves 144, and a bottom panel 148 attached to the side panels 146. The side panels 146 are attached together at the ends of the collapsible boat 100, either directly or by attaching the side panels 146 to each other via an extension (not shown) of the bottom panel 148. When the hull skin 142 is formed from separate components, the seams between these components are typically covered with a seam tape (not shown) in the manner known in the art to provide a watertight seal and increased strength and durability. Details of preferred structures for hull skins which would be suitable for use as the hull skin 142 are set forth in U.S. Pat. No. 5,915,327 of the present inventor, incorporated herein by reference.

Means for longitudinally tensioning the hull skin 142 with respect to the frame 102 are provided. The longitudinal tension of the hull skin 142 acts to maintain the gunwales 104 engaged with the gunwale-engaging clips 112 on the ribs 110. Since the longitudinal tension of the hull skin 142 causes an upwards force on the first stem element 116 and the second stem element 118, the tension also secures the first end connectors 132 on the gunwale first ends 106 with the first bracket 128 and the second end connectors 140 on the gunwale second ends 108 with the second bracket 138.

Figure 3:
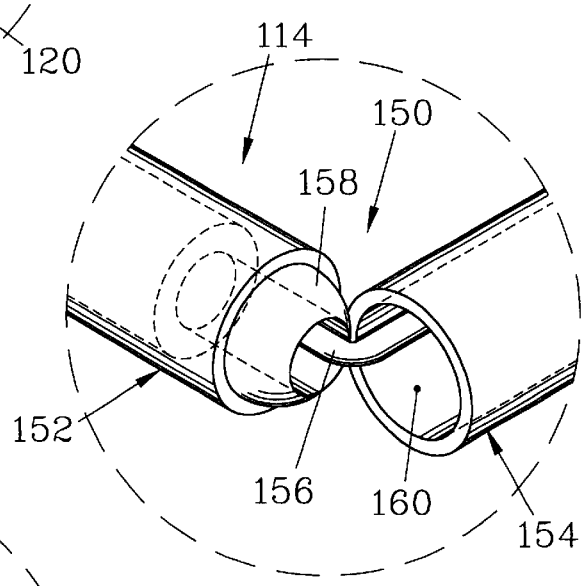
FIG. 3 is a detail view of a central joint of a keel stringer employed in the frame of the collapsible boat shown in FIG. 1.
Figure 4:
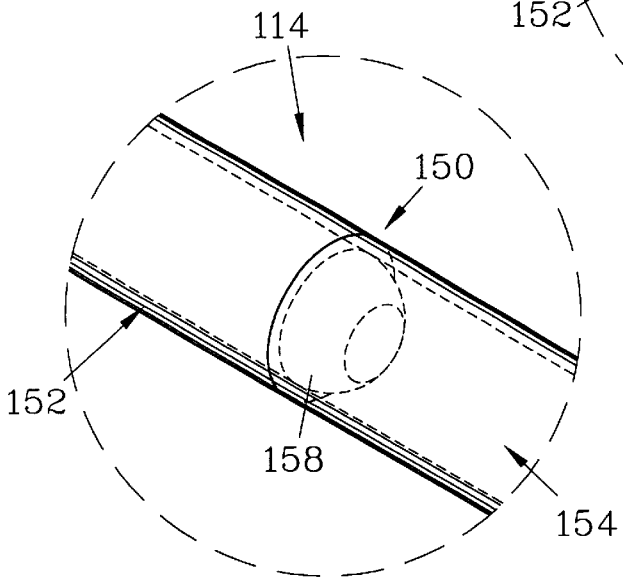
FIG. 4 is a detail view of the central joint shown on FIG. 3 where the sections of the keel stringer are aligned and the insertable section is fully inserted into the adjacent section, placing the keel stringer in a substantially straight configuration.

In the collapsible boat 100, the keel stringer 114 is employed to longitudinally tension the hull skin 142 against the frame 102, providing a simplified structure for the frame 102 compared to the frames of earlier collapsible boats. In this embodiment, the keel stringer 114 has a central joint 150, which is illustrated in FIGS. 3 and 4. The central joint 150 is spaced apart from both the first stem element 116 and the second stem element 118, and is generally centrally located in the collapsible boat 100.

The keel stringer 114 is preferably formed of multiple sections of tubing, and the central joint 150 can be conveniently provided between a stringer first section 152 and an adjacent stringer second section 154. The central joint 150 allows the stringer first section 152 and the stringer second section 154 to be disposed either in a bent configuration (shown in FIG. 3), where the stringer first section 152 and the stringer second section 154 are substantially inclined to each other, or in a substantially straight configuration (shown in FIG. 4), where the stringer first section 152 and the stringer second section 154 are substantially aligned.

In the embodiment illustrated, the central joint 150 is disconnectable, and the stringer first section 152 and the stringer second section 154 are connected together by an elastic shock cord 156, shown in FIG. 3 where the central joint 150 is disconnected. When the central joint 150 is disconnected, the keel stringer 114 is in its bent configuration.

The stringer first section 152 of this embodiment has an insertable section 158 having a rounded profile to facilitate insertion of the insertable section 158 into an open end 160 of the stringer second section 154. In one preferred embodiment where the keel stringer 114 is formed of ½ inch (13 mm) tubular stock, the insertable section 158 has a length of about ¼ inch (6 mm). The insertable section 158 is insertable into the open end 160 of the stringer second section 154, and when so inserted the insertable section 158 engages the stringer second section 154 to maintain the stringer first section 152 and the stringer second section 154 roughly in alignment, as shown in FIG. 4. When the keel stringer 114 is in the bent configuration shown in FIG. 3, rounded profile of the insertable section 158 guides the user in inserting the insertable section 158 into the open end 160. The rounded profile also allows the stringer first section 152 and the stringer second section 154 to be slightly inclined with respect to each other when the keel stringer 114 is in its substantially straight configuration while remaining engaged with each other.

To assemble the collapsible boat 100, the gunwales 104 are slid into the gunwale sleeves 144 and the keel stringer 114 is installed with the central joint 150 disconnected, such that the keel stringer 114 is in the bent configuration shown in FIG. 3. The first stem element end 120 is then positioned appropriately to be secured with respect to the gunwale first ends 106, and the second stem element end 122 is positioned appropriately to be secured with respect to the gunwale second ends 108. For example, in this embodiment the first end connectors 132 of each of the gunwales 104 are connected to the first bracket 128 on the first stem element 116 while the keel stringer 114 is in its bent configuration. The reduced length of the keel stringer 114 allows the user to connect the first end connectors 132 to the first bracket 128 without tension on the hull skin 142. Similarly, the second end connectors 140 on each of the gunwale second ends 108 are connected to the second bracket 138 on the second stem element end 122 while the keel stringer 114 is in its bent configuration.

Figure 5:
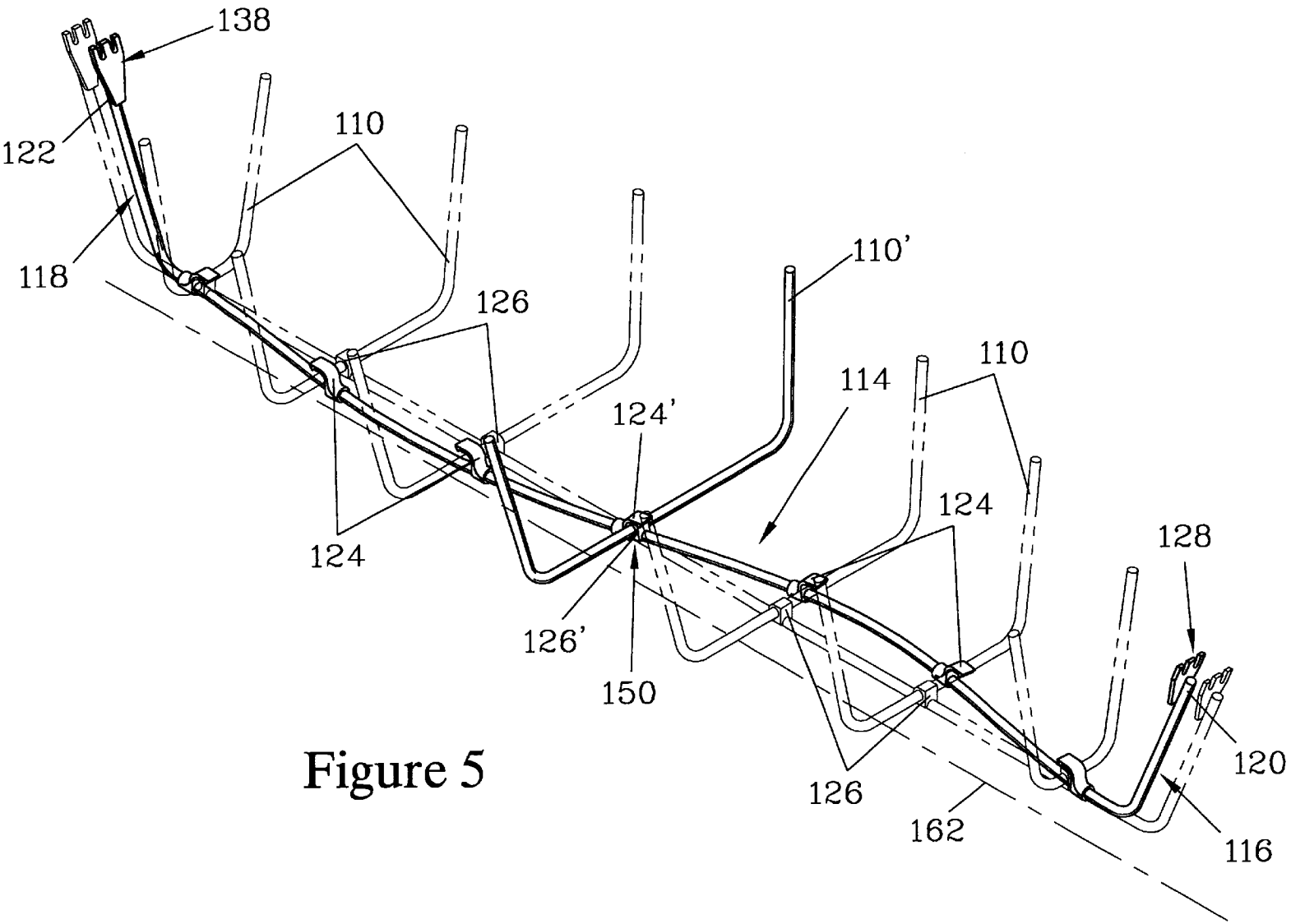
FIG. 5 illustrates the keel stringer and a central one of the ribs when the keel stringer is in its substantially straight configuration where it is bowed somewhat by tension from the hull skin (omitted for clarity). As additional ribs (shown in phantom) are added, the keel stringer is moved to a straight configuration (also shown in phantom).

After the first stem element end 120 and the second stem element end 122 are positioned appropriately, a central one of the ribs 110' (shown in FIG. 1) is then connected to the gunwales 104, and thereafter the keel stringer 114 is moved to its substantially straight configuration. In this embodiment, the insertable section 158 of the central joint 150 is inserted into the open end 160 of the stringer second section 154 to place the keel stringer 114 in its substantially straight configuration. The keel stringer 114 is also moved to a central location where the rib-engaging clip 124' on the keel stringer 114 can lockably engage the central rib 110' to maintain the keel stringer 114 in position. FIG. 5 shows the keel stringer 114 and the central rib 110' when the keel stringer 114 is in its substantially straight configuration. The gunwales 104 and the hull skin 142 are omitted from FIG. 5 to more clearly show the keel stringer 114. Preferably, the central joint 150 is located near the central rib 110'.

In its substantially straight configuration shown in FIG. 5, the effective length of the keel stringer 114 is typically limited by the engagement of the first stem element end 120 and the second stem element end 122 with respect to the hull skin 142. When the first stem element end 120 and the second stem element end 122 respectively engage the first gunwale ends 106 and the second gunwale ends 108, they are engaged with respect to the hull skin 142 via the substantially vertical portions of the first stem element 116 and the second stem element 118, which engage the end regions of the hull skin, and by the gunwales 104, which are restrained by their slidable engagement with the gunwale sleeves 144. The keel stringer 114 typically is somewhat bowed when in its substantially straight configuration, as shown in FIG. 5 where the bow is exaggerated for purposes of illustration. Furthermore, when the central joint 150 is located at or near the central rib 110', the stringer first section 152 and the stringer second section 154 may be slightly inclined with respect to each other when the keel stringer 114 is bowed. The central rib 110', which is preferably positioned in close proximity to the central joint 150, maintains the portion of the keel stringer 114 near the rib-engaging clip 124' disposed on a centerline 162 of the collapsible boat 100. However, the remaining length of the keel stringer 114 is not so restrained, allowing the keel stringer 114 to assume the bowed shape shown in FIG. 5.

It should be appreciated that, when the keel stringer 114 is sufficiently flexible, the first end connectors 132 could be connected to the first bracket 128 and the second end connectors 140 connected to the second bracket 138 when the keel stringer 114 is in its substantially straight configuration.

To provide longitudinal tension in the hull skin 142 and to maintain the keel stringer 114 straight when the collapsible boat 100 is in use, additional ribs 110 (shown in phantom) are sequentially connected to the gunwales 104 and lockably engaged with the keel stringer 114. As each rib 110 is lockably engaged with the keel stringer 114, it forces a portion of the keel stringer 114 to be disposed along the centerline 162. Thus, the keel stringer 114 is gradually forced to a straight configuration, shown in phantom in FIG. 5, where the keel stringer 114 is maintained on the centerline 162. Bringing the keel stringer 114 to its straight configuration increases the effective length of the keel stringer 114, which causes the stem elements (116, 118) and the gunwales 104 to forcibly engage the hull skin 142, thereby longitudinally tensioning the hull skin 142 against the frame 102.

The structure of the frame 102 has an advantage over the frames of prior art collapsible boats in that it employs only the gunwales 104 and the keel stringer 114 as longitudinal elements of the frame 102. The employment of only three longitudinal frame elements is advantageous in facilitating fabrication and assembly/disassembly of the collapsible boat 100, and in reducing the weight and collapsed size of the collapsible boat 100 when disassembled for transport or storage. The use of only the keel stringer 114 without supplemental stringers also limits the areas of the bottom panel 148 which are subject to abrasion, since such abrasion is greatest where the bottom panel 148 is supported directly over an element of the frame 102. This area of increased abrasion can be readily reinforced by providing a rub strip over this area, such as taught in U.S. Pat. No. 5,915,327 of the present inventor. Since the keel stringer 114 is straight when the collapsible boat 100 is assembled, there is no need to curve the rub strip, facilitating fabrication. These advantages of using the keel stringer 114 to longitudinally tension the hull skin 142 are independent of the particular means used to secure the gunwale ends (104, 106) with respect to the stem elements (116, 118), and such keel stringers could be advantageously employed as an improvement in other collapsible boats, such as those discussed in the '327 and '904 patents.

Referring again to FIG. 1, the transverse tension of the hull skin 142 over the frame 102 can be adjusted by providing a pair of inflatable compartments 164 (only one of which is shown) which reside between the side panels 146 of the hull skin 142 and the frame 102 when the collapsible boat 100 is assembled. The inflatable compartments 164 can be inflated to maintain the hull skin 142 tautly in place on the frame 102 to further secure the elements of the frame 102 together and to provide longitudinal rigidity to the collapsible boat 100. The inflatable compartments 164 can also serve to space the hull skin 142 away from the ribs 110 to provide a smooth exterior contour for the collapsible boat 100. Preferably, the inflatable compartments 164 are secured to the hull skin 142 by straps (not shown) passing through strap eyelets and rib openings in the gunwale sleeves 144, as is taught in the Background section of the present inventor's '327 patent. Preferably, these straps are formed of an elastic cord material.

Figure 2:
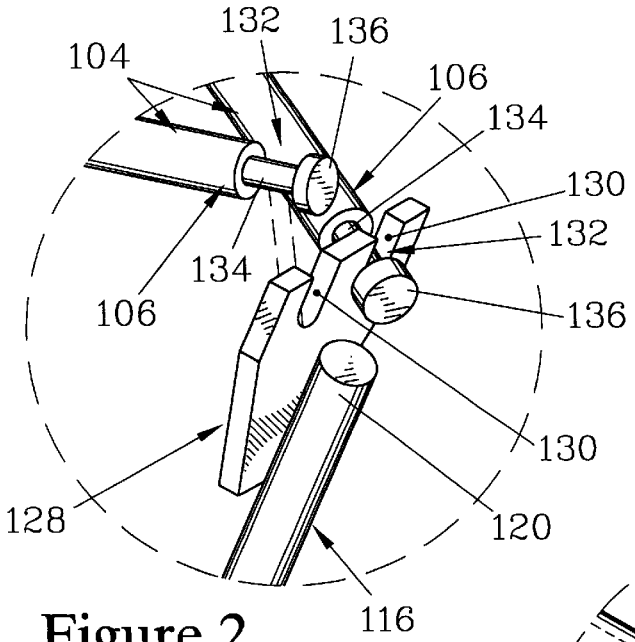
FIG. 2 is an enlarged view of the region 2 of FIG. 1, showing one of the brackets and the associated end connectors in greater detail.
Figure 6:
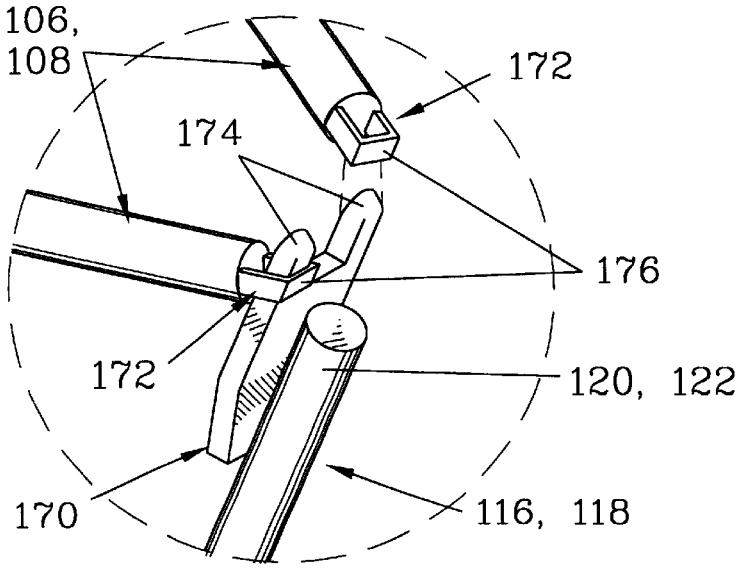
FIG. 6 is a view which corresponds to the view of FIG. 2, showing an alternative bracket and end connectors which could be employed.

FIG. 6 is a view which corresponds to the view of FIG. 2, showing an alternative bracket 170 and end connectors 172 which could be employed in the collapsible boat 100 in place of the brackets (128, 138) and the end connectors (132, 140) discussed above. In this embodiment, the bracket 170 has a pair of prongs 174, and the end connectors 172 each have a strap 176 that is configured to engage one of the prongs 174. Again, the engagement between the bracket 170 and the end connectors 172 secures the gunwale ends (106, 108) together and prevents upwards motion of the stem element (116, 118).

Figure 7:
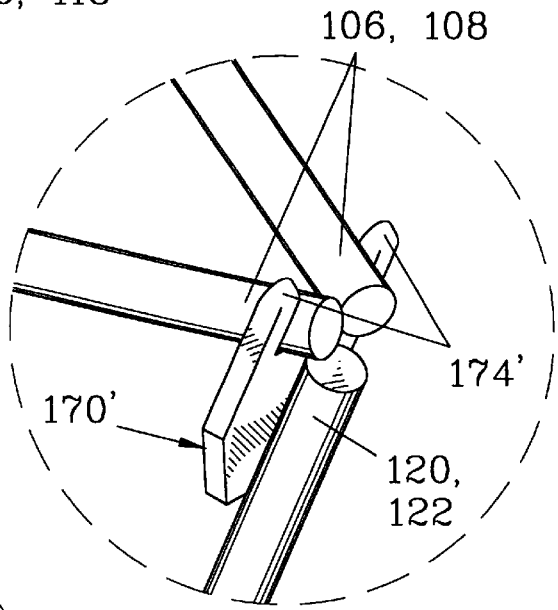
FIG. 7 is a view of an alternative bracket which could be employed to eliminate the requirement to provide separate end connectors on the gunwale ends. In this embodiment, the gunwale ends themselves serve as end connectors.

FIG. 7 illustrates an alternative bracket 170' which can be employed to eliminate the need to add additional elements to the gunwale ends (106, 108). In the alternative bracket 170', the prongs 174' are spaced widely apart to allow the gunwale ends (106, 108) to be retained therebetween. Thus, in this embodiment the gunwale ends (106, 108) themselves serve as end connectors which are connectable to the alternative bracket 170' on the stem element end (120, 122). Tension of the hull skin maintains the gunwale ends (106, 108) engaged with the alternative bracket 170'.

Figure 8:
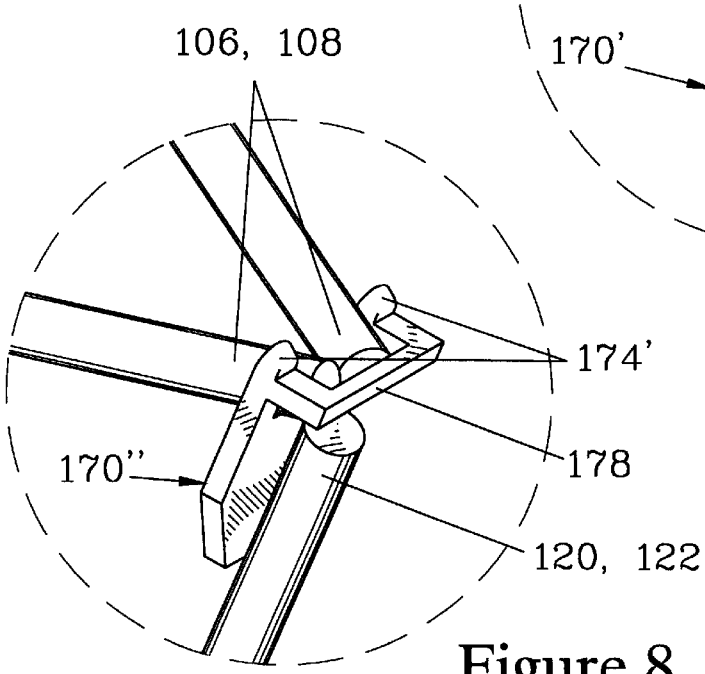
FIG. 8 is a view of another alternative bracket which could be employed to allow the gunwale ends themselves serve as end connectors.

FIG. 8 illustrates yet another alternative bracket 170" which is similar to the alternative bracket 170' discussed above, but which provides greater limits on the engagement of the alternative bracket 170" by the gunwale ends (106, 108). The alternative bracket 170" has a cross bar 178 positioned to engage the gunwale ends (106, 108) to limit their longitudinal position with respect to the alternative bracket 170". Again, the gunwale ends (106, 108) themselves serve as end connectors and are maintained in engagement with the alternative bracket 170" by tension of the hull skin.

Figure 9:
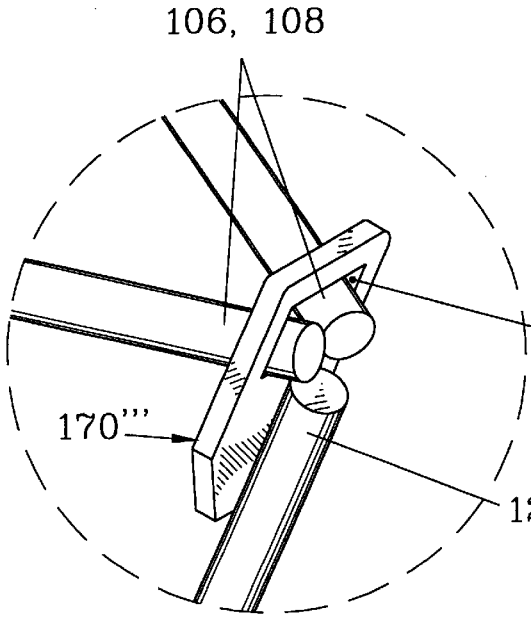
FIG. 9 is a view of yet another alternative bracket which could be employed to allow the gunwale ends themselves serve as end connectors. In this embodiment, the gunwale ends are insertable into an opening in the alternative bracket.

FIG. 9 illustrates still another alternative bracket 170'" which can be employed to eliminate the need to add additional elements to the gunwale ends (106, 108). The alternative bracket 170'" has a bracket opening 179 into which the gunwale ends (106, 108) can be inserted, the gunwale ends (106, 108) again serving as end connectors. By encircling the gunwale ends (106, 108), the alternative bracket 170'" helps maintain engagement with the gunwale ends (106, 108) during installation.

Figure 10:
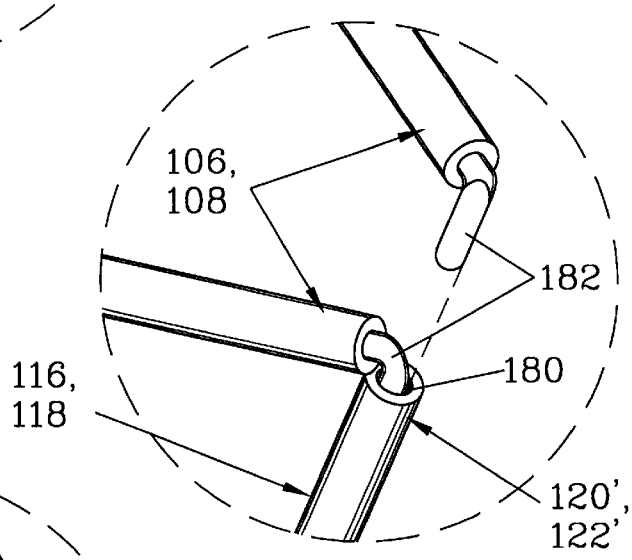
FIG. 10 is a view which corresponds to the views of FIGS. 2 and 6–9, showing end connectors which attach directly to a stem element end.

FIG. 10 is a view of another alternative embodiment, where a stem element end (120', 122') itself is provided with an opening 180 which serves the function of a bracket. In this embodiment, the gunwale ends (106, 108) are provided with end connectors 182 which are formed as pins that are both insertable into the opening 180 on the stem element end (120', 122').

Figure 11:
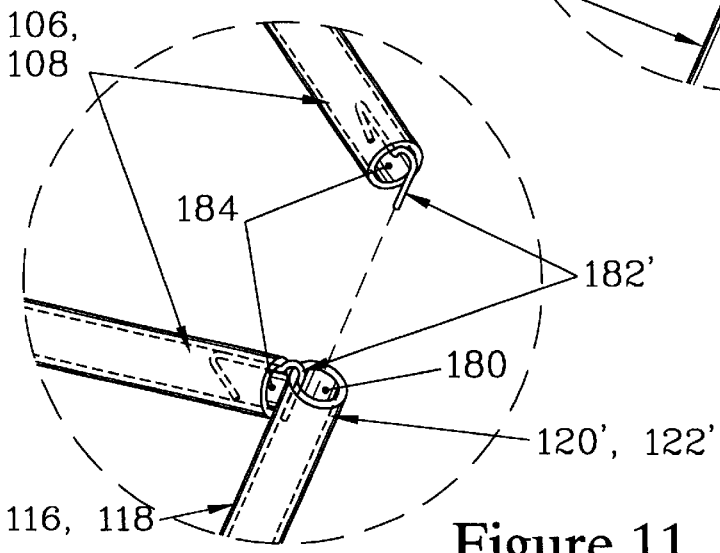
FIG. 11 is a view which corresponds to the view of FIG. 10, showing alternative end connectors which can attach directly to a stem element end.
Figure 12:
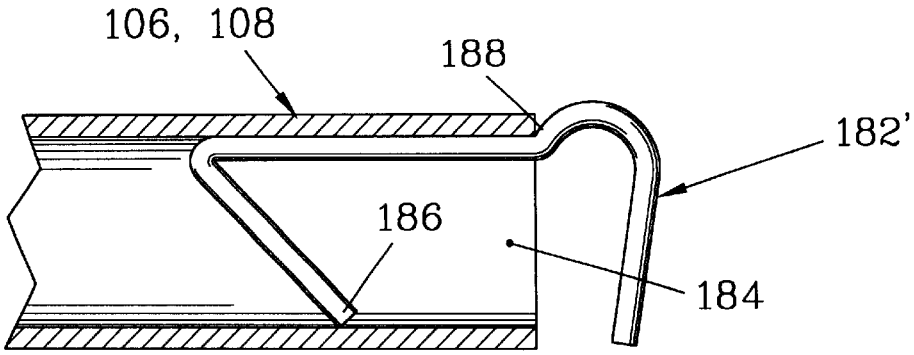
FIG. 12 is a section view of a gunwale end showing one of the end connectors shown in FIG. 11.

FIG. 11 is a view of alternative end connectors 182' which facilitate fabrication and provide a substantial degree of flexure in the attachment of the gunwale ends (106, 108) with respect to the stem element (116, 118). The end connectors 182' are again insertable into the opening 180 on the stem element end (120', 122'). The end connectors 182' are formed from a heavy, resilient metal wire and are installed simply by inserting them into open ends 184 on the gunwale ends (106, 108). The end connectors 182' are each formed to have an anchoring leg 186 which engages the open end 184 to maintain the end connectors 182' in position, as better shown in the section view of FIG. 12. The end connector 182' is preferably also formed to have a depth-setting ledge 188 which limits its insertion into the open end 184 to further facilitate fabrication.

When assembling a collapsible boat that employs the alternative end connectors 182', it may be preferable to connect one of the ribs 110 to the gunwales 104 prior to inserting the end connectors 182' into the opening 180 on the stem element end (120', 122'). The connection of the gunwales 104 to one of the ribs 110 at a location some distance from the gunwale ends (106, 108) maintains a separation of the gunwales 104 at the location of the rib 110 and causes them to approach the stem element end (120', 122') at a substantial angle, which facilitates insertion of the end connectors 182' into the opening 180 on the stem element end (120', 122').

Figure 13:
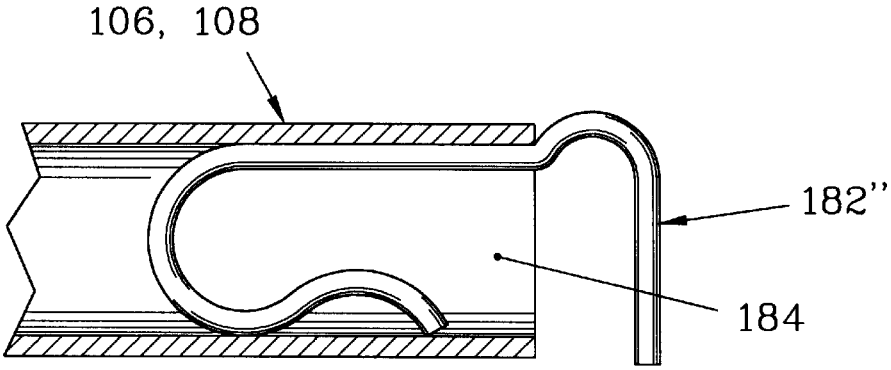
FIG. 13 is a section view showing an alternative end connector similar to that shown in FIG. 12.

FIG. 13 is a view of another alternative end connector 182" which functions in a manner similar to the end connector 182' discussed above.

It should be appreciated that the structures discussed above for connecting the gunwale ends to the stem element ends could be employed in collapsible boats independently of the other particular structures of the embodiment illustrated in FIGS. 1–5. In particular, such structure can be employed in collapsible boats such as those discussed in the '327 and '904 patents when it is desired to provide a more pointed end for improved appearance and/or to facilitate covering the collapsible boat with a deck.

Figure 14:
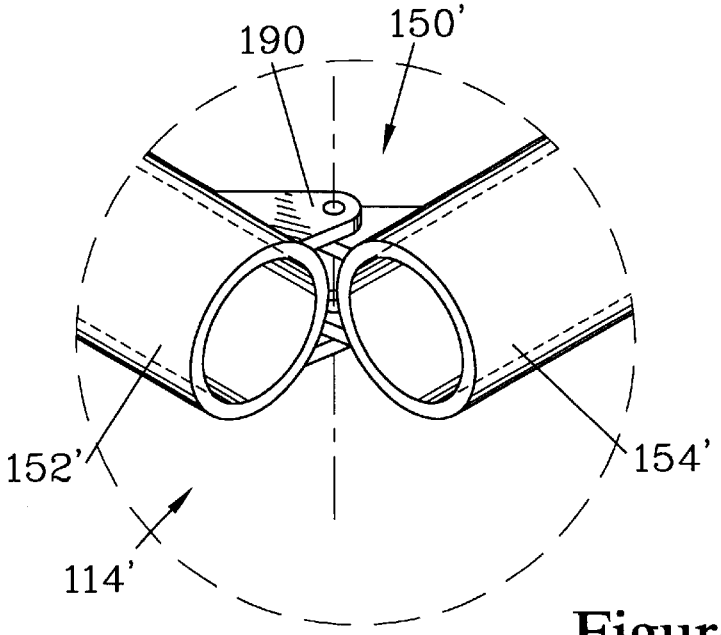
FIG. 14 is a view which corresponds to the view of FIG. 3, showing an alternative central joint which could be employed for the keel stringer.

FIG. 14 illustrates one example of an alternative central joint 150' which could be employed between the stringer first section 152' and the stringer second section 154' of the keel stringer 114'. The alternative central joint 150' employs a mechanical hinge 190 which allows the stringer first section 152 and the stringer second section 154 to pivot with respect to each other about a hinge pivot axis 192 before such time as the central rib 110' is lockably engaged by the keel stringer 114'. Once the central rib 110' and the remaining ribs 110 are lockably engaged by the keel stringer 114', in the manner discussed above with regard to the keel stringer 114, the ribs 110 maintain the keel stringer 114' on the centerline 162 and thus prevent pivoting of the stringer first section 152' and the stringer second section 154' at the central joint 150'.

While the structure employed in the collapsible boat 100 discussed above has been found to provide a collapsible boat having significantly reduced weight and complexity, the connection of the gunwales directly to the stem elements at both ends can cause difficulties in assuring accurate alignment between the frame and the hull skin. This problem can be overcome by employing part of the hull skin to provide means for securing the gunwale second ends with respect to the second stem element end. Again, while illustrated with respect to structure similar to the particular structure discussed above, the use of the hull skin to secure the gunwale second ends with respect to the second stem element end as discussed below could be employed in other collapsible boats, such as those discussed in the '327 and '904 patents.

Figure 15:
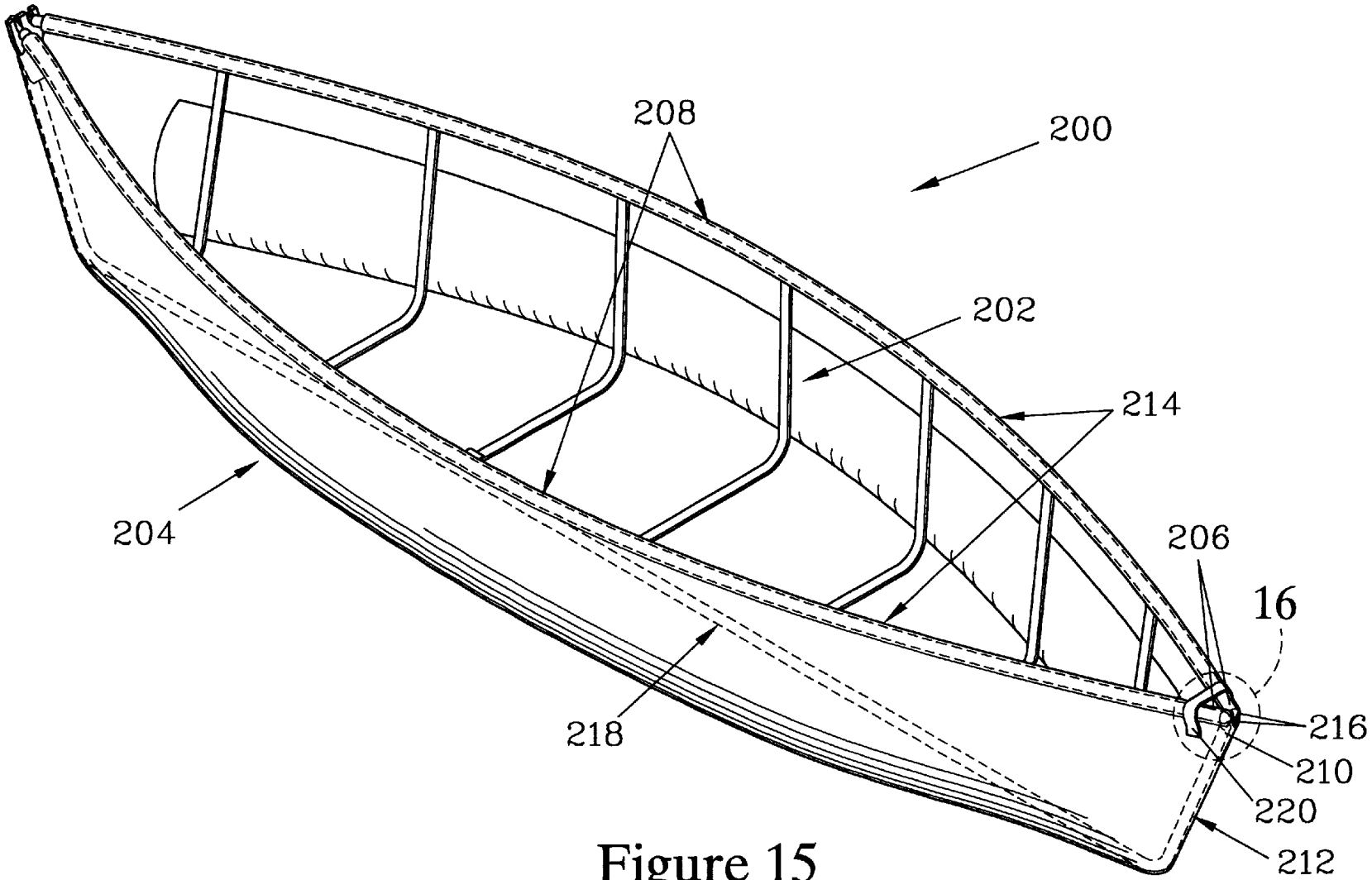
FIG. 15 is an isometric view of a collapsible boat which forms another embodiment of the present invention. The collapsible boat has a bracket at one end, and the gunwales are secured at the other end by closed sleeve ends of gunwale sleeves in which they are slidably engaged and a cross strap which extends over the ends of the gunwales.

FIG. 15 illustrates a collapsible boat 200 which forms another embodiment of the present invention, which is structured to provide greater accuracy in alignment between a frame 202 and a hull skin 204. The collapsible boat 200 illustrated is similar to the collapsible boat 100 discussed above, but differs in the means employed to secure gunwale second ends 206 of gunwales 208 with respect to a second stem element end 210 of a second stem element 212. The orientation the collapsible boat 200 is shown reversed from that of the collapsible boat 100 shown in FIG. 1 to more clearly illustrate these elements.

The hull skin 204 again has gunwale sleeves 214 which slidably engage the gunwales 208; however, the gunwale sleeves 214 of this embodiment have closed sleeve ends 216 located at the portion of the hull skin 204 which overlies the second stem element end 210. The closed sleeve ends 216 can be formed by attaching the material of the gunwale sleeves 214 together by sewing, bonding, or similar techniques known in the art. The closed sleeve ends 216 limit the slidable engagement of the gunwales 208 in the gunwale sleeves 214 such that the gunwale second ends 206 engage the closed sleeve ends 216 when the gunwale second ends 206 are positioned with respect to the hull skin 204 so as to reside above the second stem element end 210 when a keel stringer 218, to which the second stem element 212 is attached, is installed.

Figure 16:
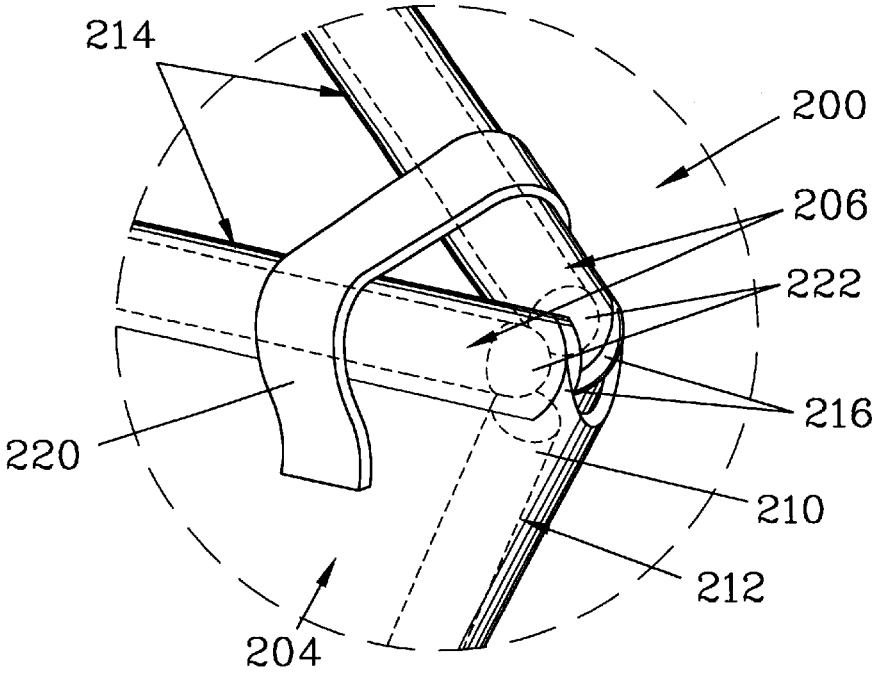
FIG. 16 is an enlarged view of the region 16 of FIG. 15, showing the interaction of the elements in greater detail.

As better shown in the detail view of FIG. 16, the hull skin 204 provides means for securing the gunwale second ends 206 together and preventing upwards motion of the second stem element end 210. Such could be provided simply by configuring the hull skin 204 such that the closed sleeve ends 216 are located in close proximity to each other, allowing the material of the hull skin 204 to secure the gunwale second ends 206 together. However, to assure that the gunwale second ends 206 are secured, it is preferred to also include a cross strap 220 which is attached to the hull skin 204 and extends over the gunwale second ends 206. The cross strap 220 is located in close proximity to the closed sleeve ends 216 of the gunwale sleeves 214, and positively secures the gunwale sleeves 214 together such that, when the gunwales 208 reside therein, the gunwale second ends 206 are maintained next to each other.

As noted above, the closed sleeve ends 216 are located such as to position the gunwale second ends 206 above the second stem element end 210 when the keel stringer 218 is installed into the collapsible boat 200. Thus, when the frame 202 is longitudinally tensioned with respect to the hull skin 204, the resulting upwards force on the second stem element 212 causes the second stem element end 210 to forcibly engage the gunwale second ends 206 in the gunwale sleeves 214. The gunwale second ends 206, which are secured together by the cross strap 220, act to block upwards motion of the second stem element end 210. Thus, the closed sleeve ends 216, the cross strap 220, and tension of the hull skin 204 serve in combination to secure the gunwale second ends 206 with respect to the second stem element end 210.

Preferably, the cross strap 220 is formed from the same material employed for the hull skin 204 to facilitate bonding the cross strap 220 thereto. The cross strap 220 is preferably fixed and non-adjustable to simplify its structure. It should be appreciated that the cross strap 220 could be extended to the end of the collapsible boat 200 so as to form a cap over the gunwale second ends 206 for improved appearance.

When the gunwale sleeves 214 are provided with closed sleeve ends 216, it is preferred for the gunwale second ends 206 to be provided with blunt terminators 222 to prevent damage to the closed sleeve ends 216. When the gunwales 208 are formed from tubing, the blunt terminators 222 can be readily fabricated as molded pieces which insert into the ends of the tubing.

While the collapsible boat 200 is illustrated as employing a first bracket and first end connectors for securing the gunwale first ends with respect to the first stem element end, it should be appreciated that the use of the closed sleeve ends 216 in combination with means for securing the gunwale second ends 206 together and preventing upwards motion of the second stem element end 210 could be employed in collapsible boats having various means for securing the gunwale first ends with respect to the first stem element end.

Figure 17:
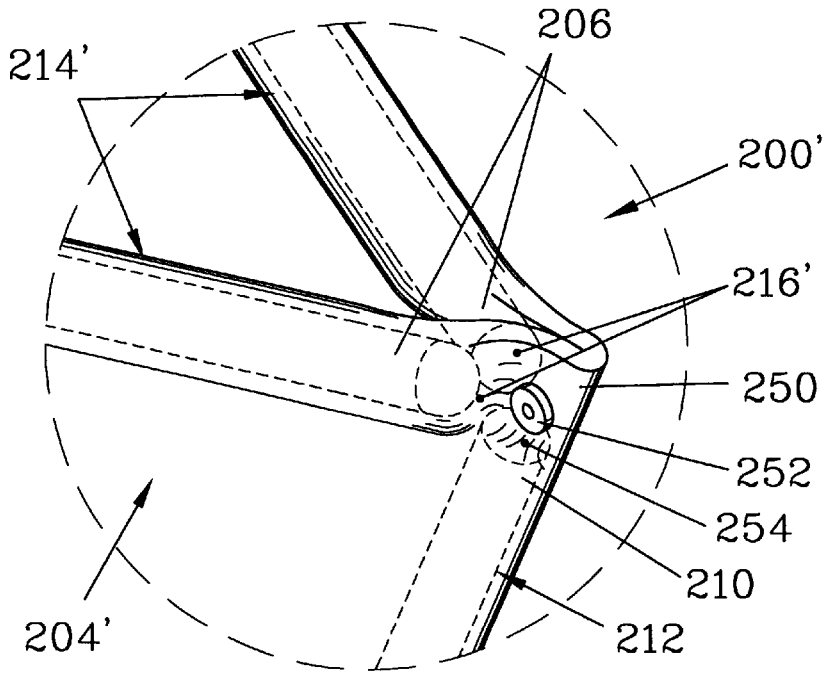
FIG. 17 is a view which corresponds to that of FIG. 16, showing an alternative structure for the end of the collapsible boat where the gunwale sleeves have closed sleeve ends. In this embodiment, a fold of the hull skin is secured with a fastener to provide improved alignment between the gunwales and the hull skin. The fastener can also secure the fabric of the gunwale sleeves together to form permanently closed ends for the gunwale sleeves.

FIG. 17 illustrates a portion of a collapsible boat 200' which differs from the collapsible boat 200 discussed above in the particular means employed for securing the gunwale second ends 206 together and preventing upwards motion of the second stem element end 210. Again, these means could be employed in collapsible boats having various means for securing the gunwale first ends with respect to the first stem element end.

In the collapsible boat 200', the hull skin 204' has a fold 250 secured by a fastener 252. The fastener 252 secures the material of the fold 250 together, which serves both to form the closed sleeve ends 216' of the gunwale sleeves 214' and to maintain the closed sleeve ends 216' together. The fastener 252 also forms a pocket 254 in the material of the hull skin 204'. The fastener 252 can be provided by a rivet, nut-and-bolt assembly, or similar mechanical fastener which can secure the material of the hull skin 204' together.

The pocket 254 is positioned to accept the second stem element end 210 and serves to prevent upwards motion of the second stem element end 210. Again, longitudinal tension of the frame 202 with respect to the hull skin 204' creates an upwards force on the second stem element 212, causing the second stem element end 210 to forcibly engage the pocket 254 so as to be secured therein. In this embodiment, the gunwale second ends 206 are secured with respect to the second stem element end 210 via the hull skin 204', since tension of the hull skin 204' serves to secure the gunwale second ends 206 in the closed sleeve ends 216' and to secure the second stem element end 210 in the pocket 254. The use of the closed sleeve ends 216' in combination with the fold 250 and fastener 252 could again be employed in collapsible boats having various means for securing the gunwale first ends with respect to the first stem element end.

In both of the collapsible boats 200 and 200' discussed above, since the closed sleeve ends (216, 216') are permanently closed, the structure shown can only be used at one end of the collapsible boat (200, 200'), as the other ends of the gunwale sleeves (214, 214') must be designed to allow access for inserting and removing the gunwales 208. To allow the use of such structure at both ends of the collapsible boat to secure the gunwale ends together, the closed sleeve ends on at least one end of the boat can be made openable.

Figure 18:
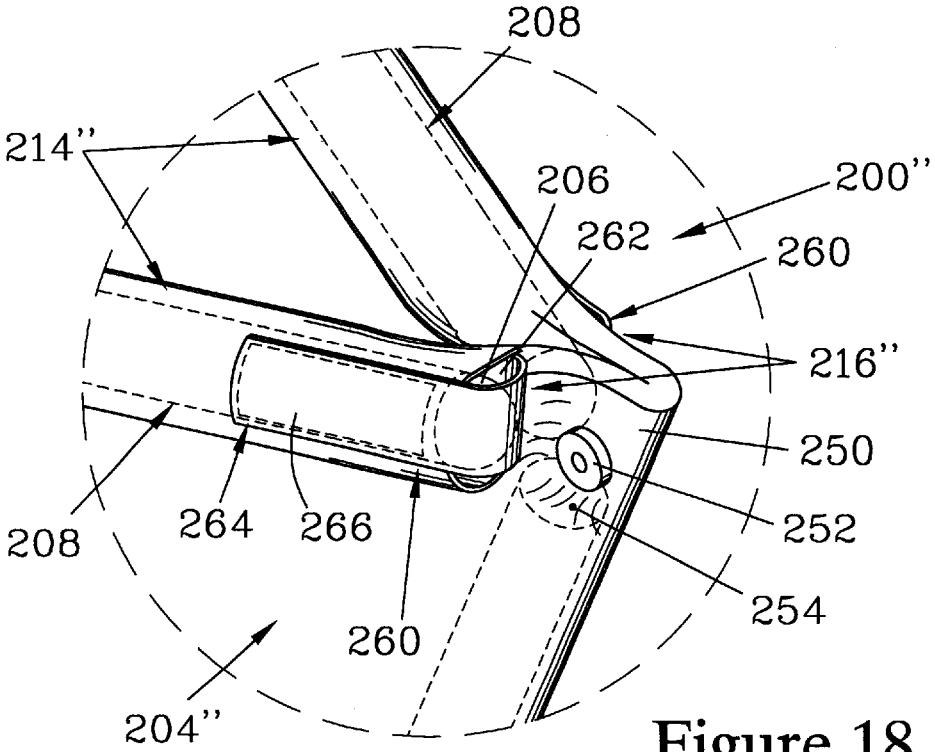
FIG. 18 is a view which corresponds to that of FIG. 17, showing closed sleeve ends for the gunwale sleeves which are openable. The gunwale sleeves each have a closure flap which extends over the end and is secured to the gunwale sleeve to close the end.
Figure 19:
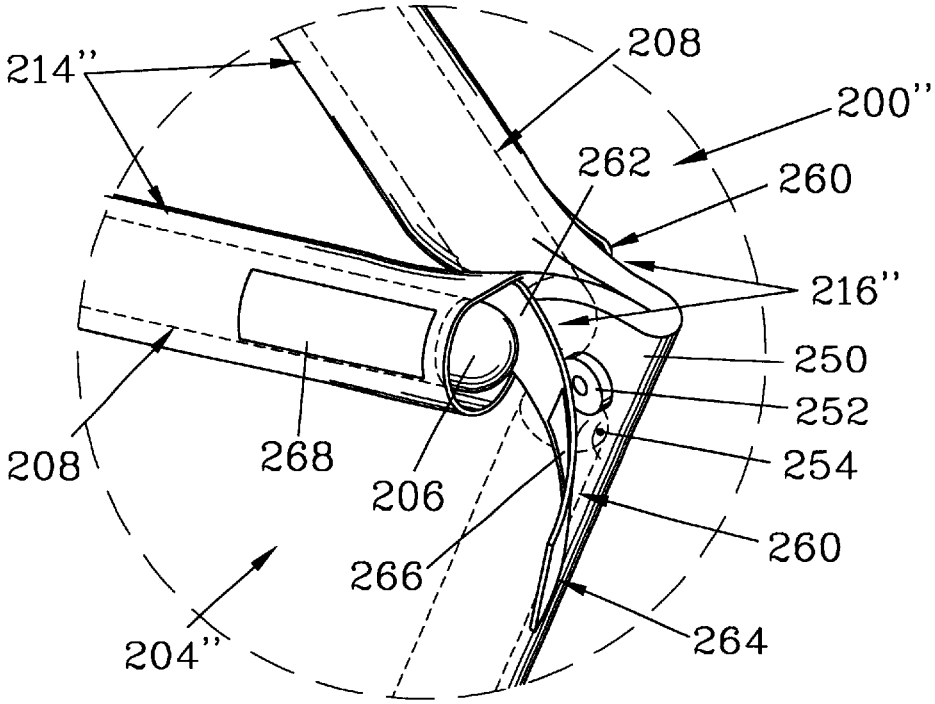
FIG. 19 is a view of the gunwale sleeve end shown in FIG. 18, when the closure flap has been released from one of the gunwale sleeves to open the closed sleeve end, allowing the gunwale to be inserted or removed from the gunwale sleeve.

FIGS. 18 and 19 illustrate closed sleeve ends 216" of gunwale sleeves 214", which offer one alternative from the closed sleeve ends 216' shown in FIG. 17 to provide closed sleeve ends 216" that are openable. FIG. 18 shows both closed sleeve ends 216" when closed, while FIG. 19 shows one of the closed sleeve ends 216" opened to allow the gunwale 208 to be inserted into or removed from the gunwale sleeve 214". This structure could be employed at one or both ends of a collapsible boat 200", and is well suited for use at one end while one of the structures shown in either FIG. 16 or FIG. 17 is used at the other end.

The hull skin 204" of the collapsible boat 200" is illustrated as having the fold 250 secured by the fastener 252, as is employed in the embodiment shown in FIG. 17, but the cross strap 220 as shown in FIG. 16 could alternatively be employed. The fastener 252 in this embodiment secures the material of the fold 250 together to maintain the closed sleeve ends 216" together and forms the pocket 254 in the material of the hull skin 204', but in this embodiment does not serve to form the closed sleeve ends 216" of the gunwale sleeves 214".

To close the closed sleeve ends 216", the closed sleeve ends 216" are each provided with a closure strap 260 which has a fixed end 262 and a free end 264. The fixed end 262 is affixed with respect to the gunwale sleeve 214", and is preferably formed integrally therewith. The free end 264 is provided with a strap fastening element 266 (best shown in FIG. 19) which attaches to a mating sleeve fastening element 268 (shown in FIG. 19) provided on the gunwale sleeve 214". The sleeve fastening element 268 is positioned on the gunwale sleeve 214" such that, when the strap fastening element 266 is attached to the sleeve fastening element 268, as shown in FIG. 18, the closure strap 260 passes over the gunwale second end 206 and limits the position of the gunwale second end 206 with respect to the gunwale sleeve 214". When so closed, the closed sleeve end 216" functions in the same manner as the closed sleeve ends (216, 216') discussed above. The strap fastening element 266 and the sleeve fastening element 268 are preferably formed from mating halves of a hook-and-loop fastening strip material, which can be sewn to the fabric of the gunwale sleeve 214" and the closure strap 260. Alternative fastening elements could be employed, such as snaps, buckles, D-rings, and other elements known in the art for fastening straps.

To allow the gunwale 208 to be removed from the gunwale sleeve 214" for disassembly of the collapsible boat 200", or to allow the gunwale 208 to be inserted into the gunwale sleeve 214" when the collapsible boat 200" is assembled, the free end 264 of the closure strap 260 is removed from engagement with the sleeve fastening element 268, as is shown in FIG. 19. This opens the closed sleeve end 216", and the closure strap 260 can be moved to a position where it no longer limits slidable motion between the gunwale 208 and the gunwale sleeve 214".

While the closed sleeve ends 216" illustrated employ closure straps 260, it should be appreciated that other structures for openably closing the closed sleeve ends 216" could be employed.

The collapsible boats discussed above are suitable for use as open canoes, and can be adapted for use as kayaks by providing a deck skin and supporting structure. FIGS. 20–23 illustrate a collapsible kayak 300 which is formed by adding additional elements to the collapsible boat 100 discussed above to provide one example of a deck skin and related structure which can be employed.

Figure 20:
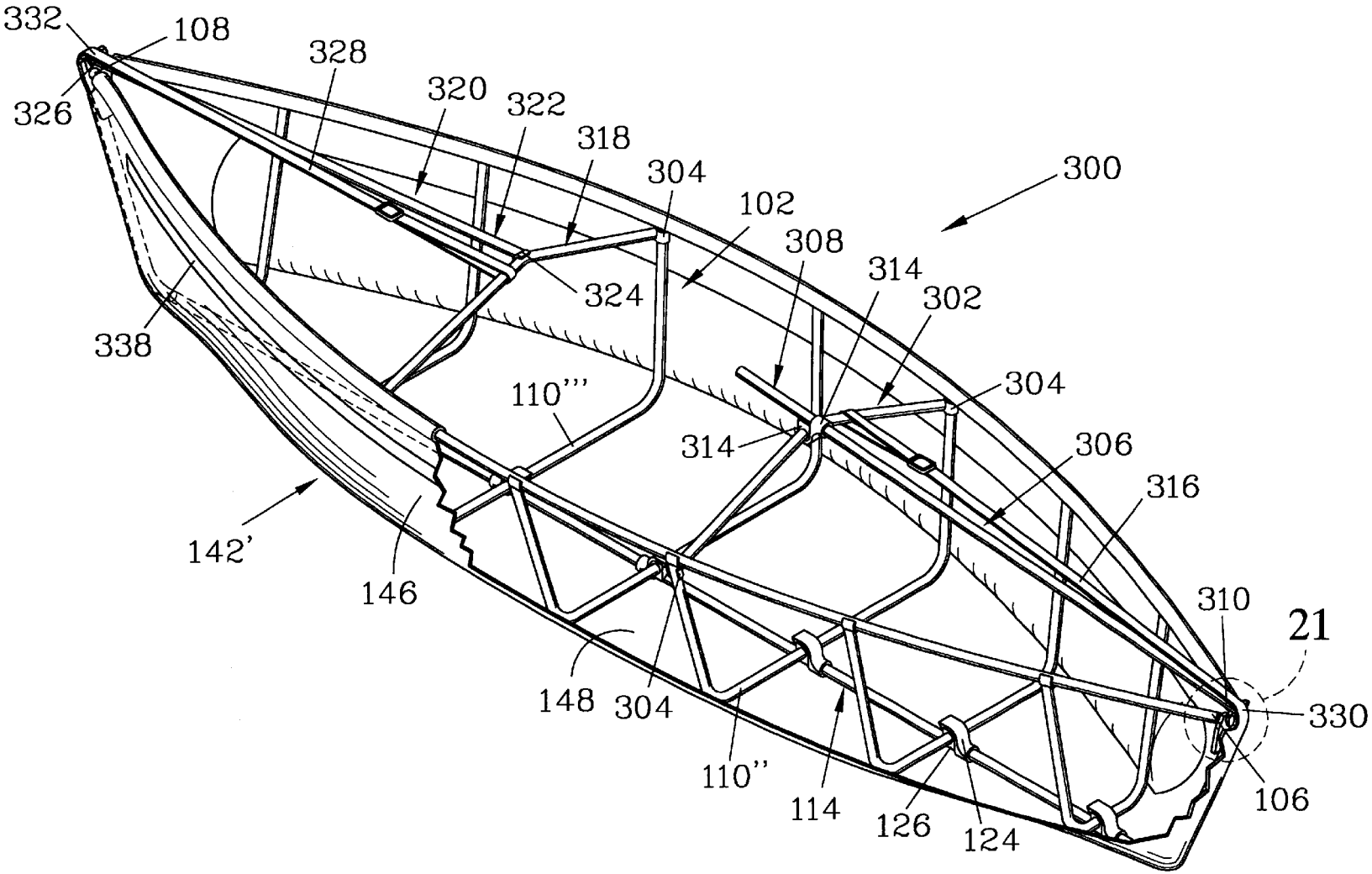
FIG. 20 is an isometric view of the collapsible boat shown in FIG. 1 where structural elements have been added to make the collapsible boat suitable for use as a kayak.
Figure 21:
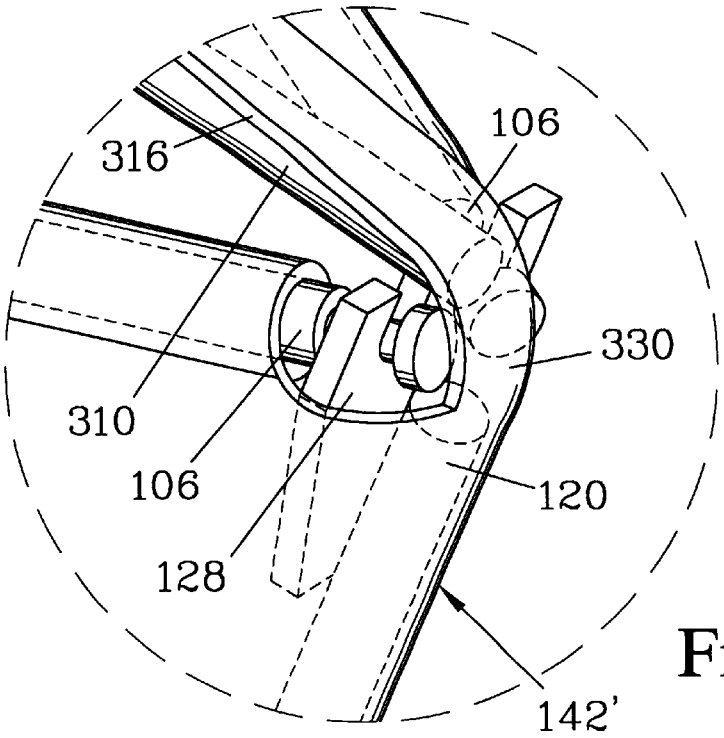
FIG. 21 is an enlarged view of the region 21 of FIG. 20, showing the interaction of the elements in greater detail.

As shown in FIG. 20, the collapsible kayak 300 has a first deck support member 302 which attaches to the frame 102 such that the first deck support member 302 extends parallel to the ribs 110. In the embodiment illustrated, the first deck support member 302 is provided with rib-engaging clips 304 which allow the first deck support member 302 to be attached to the rib 110". The rib-engaging clips 304 can be essentially similar to the gunwale-engaging clips 112 on the ribs 110.

A first deck stringer 306 is also provided, which has a first deck stringer inner end region 308 and a first deck stringer outer end region 310. The first deck stringer inner end region 308 is configured to engage the first deck support member 302, and preferably has a first support member-engaging clip 312 which attaches to the first deck support member 302. In this embodiment, the first deck stringer inner end region 308 extends somewhat beyond the first deck support member 302, and the first support member-engaging clip 312 can be essentially similar to the rib-engaging clips 124 on the keel stringer 114. The first deck support member 302 is preferably provided with a clip-engaging attachment 314 similar to the clip-engaging attachments 126 on the ribs 110 discussed above.

The first deck stringer outer end region 310 is configured to reside above the gunwale first ends 106 of the gunwales 104. Means are provided for securing the first deck stringer outer end region 310 with respect to the gunwale first ends 106, these means being associated with the hull skin 142'. In this embodiment, a first support strap 316 is attached to the hull skin 142' and extends over the first deck stringer outer end region 310. The first deck support strap 316 passes around the first deck support member 302 and fastens to itself, thereby limiting longitudinal motion of the first deck support member 302. As better shown in FIG. 21, the extension of the first support strap 316 over the first deck stringer outer end region 310 holds the first deck stringer outer end region 310 against the gunwale first ends 106, which form a cradle to maintain the first deck stringer outer end region 310 in position. It should be noted that the first deck stringer outer end region 310 and the first bracket 128 could be modified to allow the first bracket 128 to maintain the first deck stringer outer end region 310 in position.

The collapsible kayak 300 also has a second deck support member 318 and a second deck stringer 320. The second deck support member 318 is attached to the frame 102 so as to extend parallel to the series of ribs 110, and in this embodiment attaches to the rib 110'" by rib-engaging clips 304. The second deck stringer 320 has a second deck stringer inner end region 322, which engages the second deck support member 318 by a second support member-engaging clip 324. In this embodiment, the second deck stringer inner end region 322 terminates at the second deck support member 318, and the second support member-engaging clip 324 can be essentially similar to the rib-engaging clips 304. The second deck stringer 320 also has a second deck stringer outer end region 326, which resides above the gunwale second ends 108. Means are provided for securing the second deck stringer outer end region 326 with respect to the gunwale second ends 108, these means again being associated with the hull skin 142'. In the collapsible kayak 300, a second support strap 328 is attached to the hull skin 142' and extends over the second deck stringer outer end region 326. The second deck support strap 328 passes around the second deck support member 318 and fastens to itself to limit longitudinal motion of the second deck support member 318, and the extension of the second support strap 328 over the second deck stringer outer end region 326 holds the second deck stringer outer end region 326 against the gunwale second ends 108.

Preferably, the hull skin 142' is formed with a first hull skin extension 330, which extends over the first deck stringer outer end region 310 to serve as part of the first support strap 316. Similarly, it is preferred for a second hull skin extension 332 to be provided, which extends over the second deck stringer outer end region 326 and serves as a portion of the second support strap 328. The first hull skin extension 330 and the second hull skin extension 332 can be formed by extensions of the bottom panel 148 which also serve to attach the side panels 146 to each other.

Figure 22:
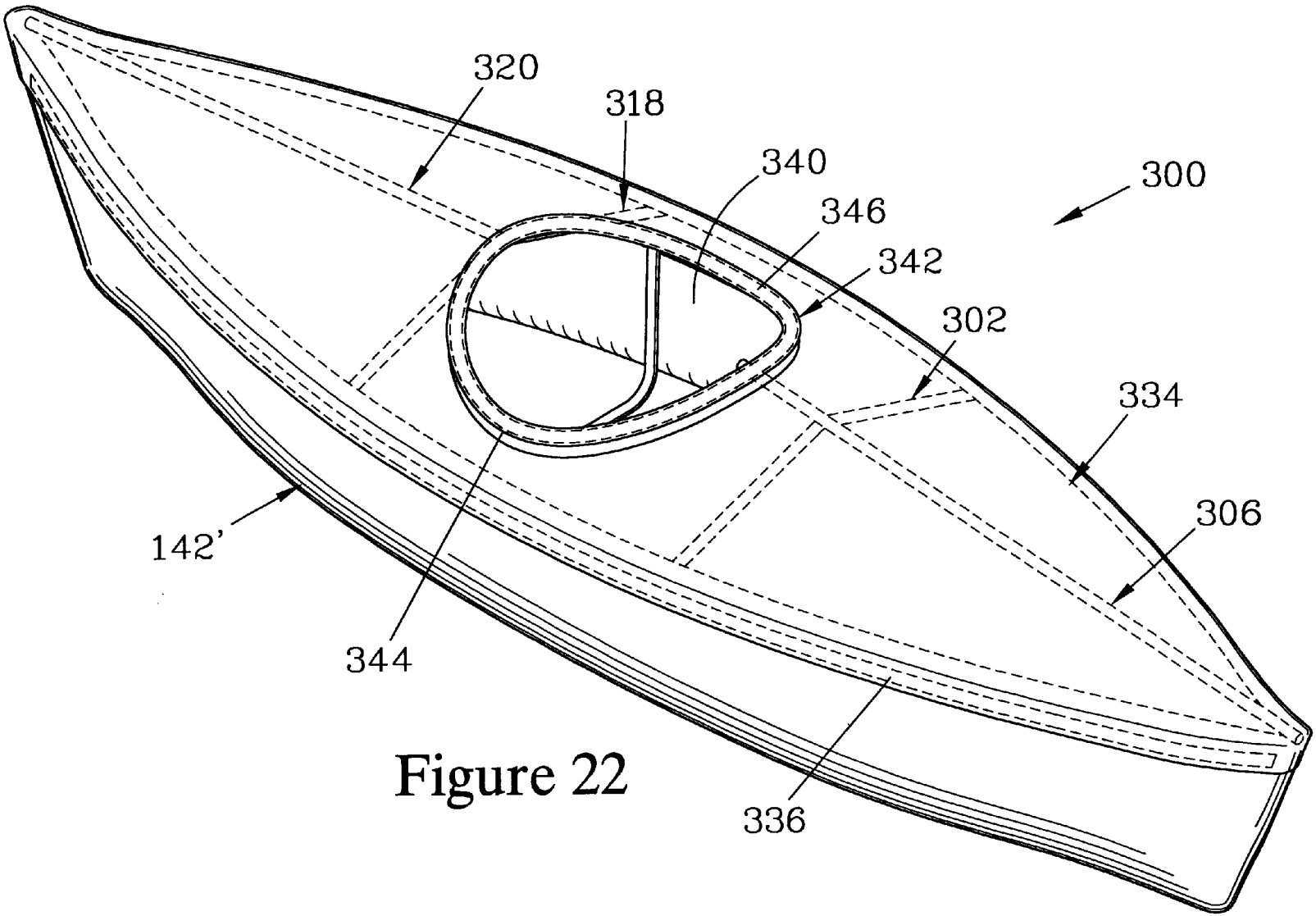
FIG. 22 is a view of the collapsible boat shown in FIG. 20 after a deck skin has been added.

As shown in FIG. 22, a deck skin 334 covers the first deck support member 302, the first deck stringer 306, the second deck support member 318, and the second deck stringer 320, the deck skin 334 attaching to the hull skin 142'. The deck skin 334 preferably has a deck fastener region 336 (shown by hidden lines) on each side, which mates to a corresponding hull fastener region 338 (shown in FIG. 20) attached to the hull skin 142' at or near the gunwale sleeves 144. When the gunwale sleeves 144 are separate elements sewn to the side panels 146, it is preferred for the lower edge of the hull fastener region 338 to be aligned with the lower edge of the gunwale sleeves 144. The deck fastener region 336 and the hull fastener region 338 are configured to be attachable and detachable with each other, and can be provided by a row of snaps or strips of hook-and-loop fastener material. Preferably, the deck fastener region 336 is provided by the loop half of a strip of hook-and-loop fastener, while the hull fastener region 338 is provided by the hook half of the strip of hook-and-loop fastener. When hook-and-loop fastener material is employed, fabrication of the collapsible kayak 300 can be facilitated by providing the halves as self-adhesive strips which are adhered to the hull skin 142' and to the deck skin 334 to secure the strips in the proper position, and thereafter are sewn for permanent attachment. The use of hook-and-loop fastener material for the deck fastener region 336 and the hull fastener region 338 also reduces the requirements for precise alignment between these two elements to secure the deck skin 334 to the hull skin 142'. Typically, the deck skin 334 is attached by first fitting one end of the deck skin 334 over the gunwale ends (106 or 108) at one end of the collapsible kayak 300, then stretching the deck skin 334 sufficiently to fit the other end over the gunwale ends (106 or 108) at the other end of the collapsible kayak 300, and then attaching the deck fastener region 336 to the hull fastener region 338 along the sides of the collapsible kayak 300

The deck skin 334 has a cockpit opening 340 to allow a user to sit in the collapsible kayak 300. The cockpit opening 340 is preferably surrounded by a raised coaming 342 to prevent entry of water and to allow the user to attach a spray skirt (not shown) to seal the cockpit opening 340 in the manner well known in the art. In the collapsible kayak 300, the raised coaming 342 is formed by a coaming sleeve 344 which surrounds the cockpit opening 340, and a tubular coaming member 346 that resides in the coaming sleeve 344. The tubular coaming member 346 is supported on the first deck stringer inner end region 308 and the second deck stringer inner end region 322. The coaming sleeve 344 is preferably formed of a fabric having substantial elasticity to prevent wrinkling and provide a smoother appearance. Neoprene material having a nylon facing has been found suitable for the coaming sleeve 344.

Figure 23:
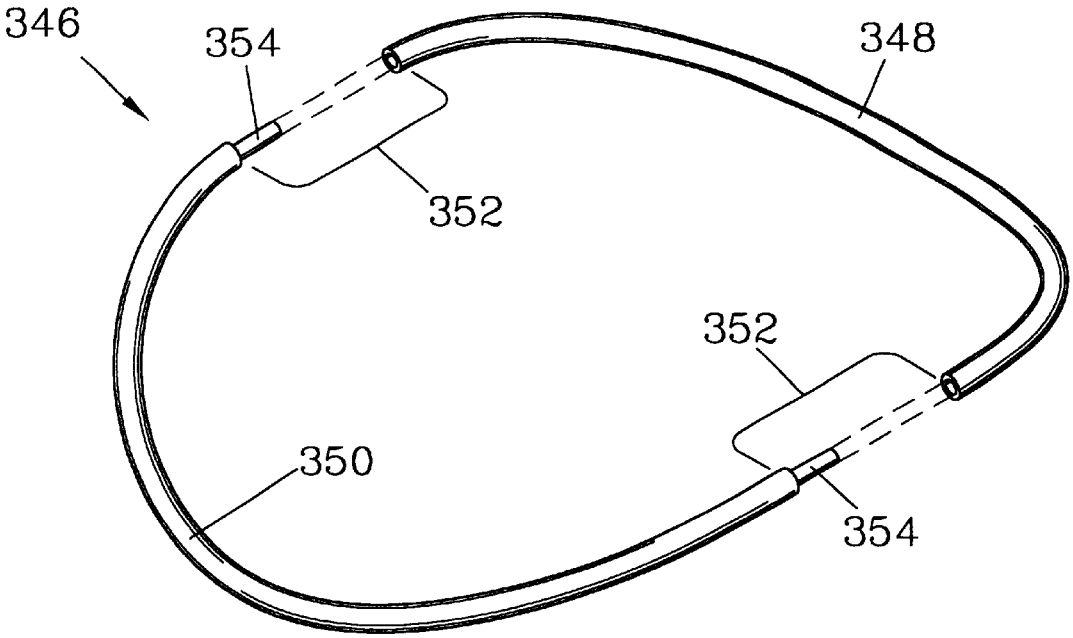
FIG. 23 is a view showing a preferred structure for a coaming sleeve and tubular coaming member which can be employed in the embodiment shown in FIG. 22.

The tubular coaming member 346 of this embodiment is formed as a two-part structure, as shown in the exploded view of FIG. 23, having a coaming member first half 348 and a coaming member second half 350. The coaming member first half 348 and the coaming member second half 350 are preferably rigid, and can be formed from tubing similar to that used for the frame 102. The coaming member first half 348 and the coaming member second half 350 are connected together by two hinged areas 352, which allow the tubular coaming member 346 to be folded for storage when the collapsible kayak 300 is collapsed. The hinged areas 352 can be formed by connecting the coaming member first half 348 and the coaming member second half 350 together with lengths of a flexible material 354 such as shock cord, which can be riveted or otherwise secured to the coaming member first half 348 and the coaming member second half 350. The flexible material must be sufficiently strong as to maintain the ends of the coaming member first half 348 and the coaming member second half 350 in alignment to prevent the ends of the coaming member first half 348 and the coaming member second half 350 from passing by each other, as such might cause the tubular coaming member 346 to collapse when a spray skirt is installed over the raised coaming 342. Preferably, the coaming member first half 348 and the coaming member second half 350 are permanently housed in the coaming sleeve 344.

Figure 24:
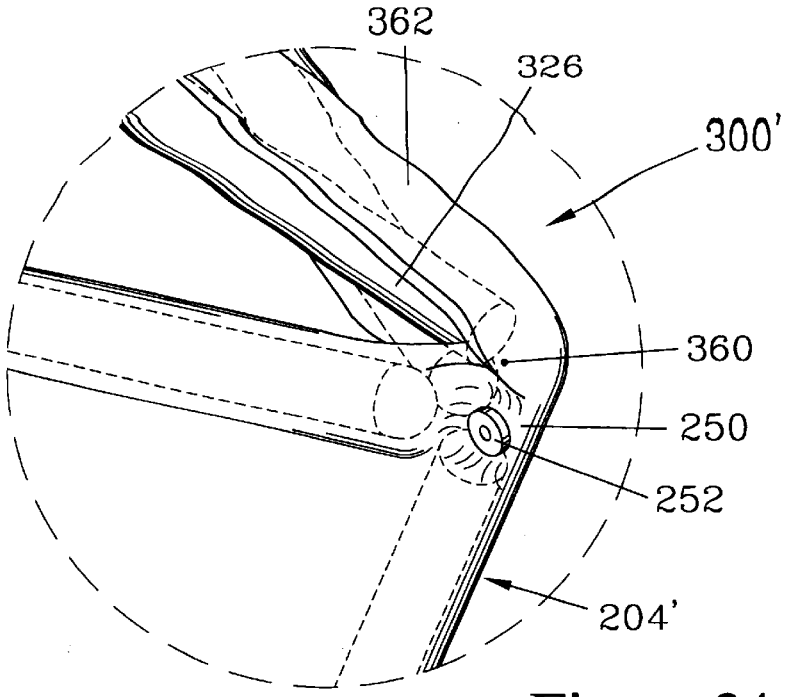
FIG. 24 is a view corresponding to that of FIG. 21, for an embodiment which employs the end structure shown in FIG. 17.

FIG. 24 is a partial view of an alternative collapsible kayak 300' which can be formed by adding a deck skin (not shown) and related structure to the collapsible boat 200' shown in FIG. 17. In this embodiment, the second deck stringer outer end region 326 resides in a pocket 360 formed in the fold 250 by the fastener 252. The pocket 360 resides above the fastener 252, and the fold 250 is formed in the hull skin 204' at or near the location of attachment of a second support strap 362 which extends over the second deck stringer outer end region 326 to secure the second deck stringer outer end region 326 in the pocket 360. It should be noted that the first deck stringer outer end region 310 of the collapsible kayak 300' is secured in the same manner as in the collapsible kayak 300 discussed above. It should be appreciated that similar collapsible kayaks could be formed by adding a deck skin and related structure to the collapsible boats 200 and 200", details of which are shown in FIGS. 16 and 18–19.

Figure 25:
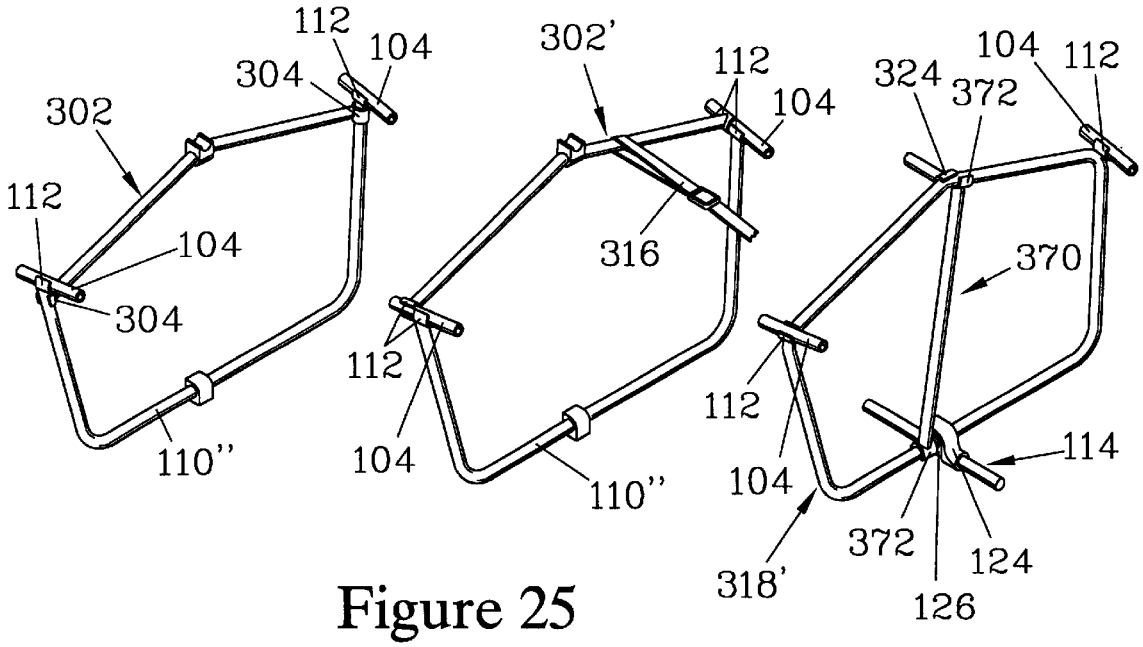
FIG. 25 is a view showing alternative structures for a deck support member which could be employed in the embodiment shown in FIGS. 20–23.

While the use of deck support members which clip onto the ribs, such as the first deck support member 302 and the second deck support member 318 discussed above, has been found effective, it should be appreciated that alternative deck support members could be employed. FIG. 25 illustrates the first deck support member 302 as well as an alternative first deck support member 302', which could be employed in place of the first deck support member 302. A similar structure could be employed in place of the second deck support member 318. FIG. 25 also shows an integrated rib and second deck support member 318', which is designed to be employed in place of the second deck support member 318; however, a similar structure could be employed to replace the first deck support member 302.

The alternative first deck support member 302' is structurally similar to the first deck support member 302, but terminates in gunwale-engaging clips 112 such as those employed on the ribs 110. The alternative first deck support member 302' attaches to the gunwales 104, preferably at a location near where the rib 110" attaches to the gunwales 104. It is preferred for the alternative first deck support member 302' to attach to the gunwales 104 just inwards from the location where the rib 110" attaches so that the gunwale-engaging clips 112 on the rib 110" prevent outward motion of the alternative first deck support member 302', allowing the first deck support strap 316 to be tightened around the alternative first deck support member 302'.

The integrated rib and second deck support member 318' is an integral structure which is designed to replace both the second deck support member 318 and the rib 110'" (shown in FIG. 20), and has both gunwale-engaging clips 112, for attachment to the gunwales 104, and a centrally positioned clip-engaging attachment 126, for attachment to one of the rib-engaging clips 124 on the keel stringer 114. The integrated rib and second deck support member 318' is advantageous in providing a rigid connection of the deck support structure to the frame and in simplifying the assembly and disassembly of the collapsible boat. A similar integrated unit could be employed to replace the first deck support 302 and the rib 110".

In the collapsible kayak 300 illustrated, the gunwale second ends 108 and the second stem element 118 define the stern of the collapsible kayak 300, and the integrated rib and second deck support member 318' is designed to be positioned just behind the cockpit opening 340. In this case, it is preferred for the integrated rib and second deck support member 318' to be provided with one or more substantially vertical support members 370. Users frequently sit on the collapsible kayak 300 behind the cockpit opening 340 when entering and exiting the collapsible kayak 300, and the substantially vertical support member 370 helps assure that the integrated rib and second deck support member 318' can support the weight of the user. The substantially vertical support member 370 illustrated is slightly inclined so as to be substantially normal to the integrated rib and second deck support member 318' where the substantially vertical support member 370 is attached thereto. This facilitates engagement of the integrated rib and second deck support member 318' by vertical support member clips 372 on the substantially vertical support member 370, and assures that the vertical support member clips 372 do not interfere with the rib-engaging clips 124, the clip-engaging attachment 126, or the second support member-engaging clip 324.

Figure 26:
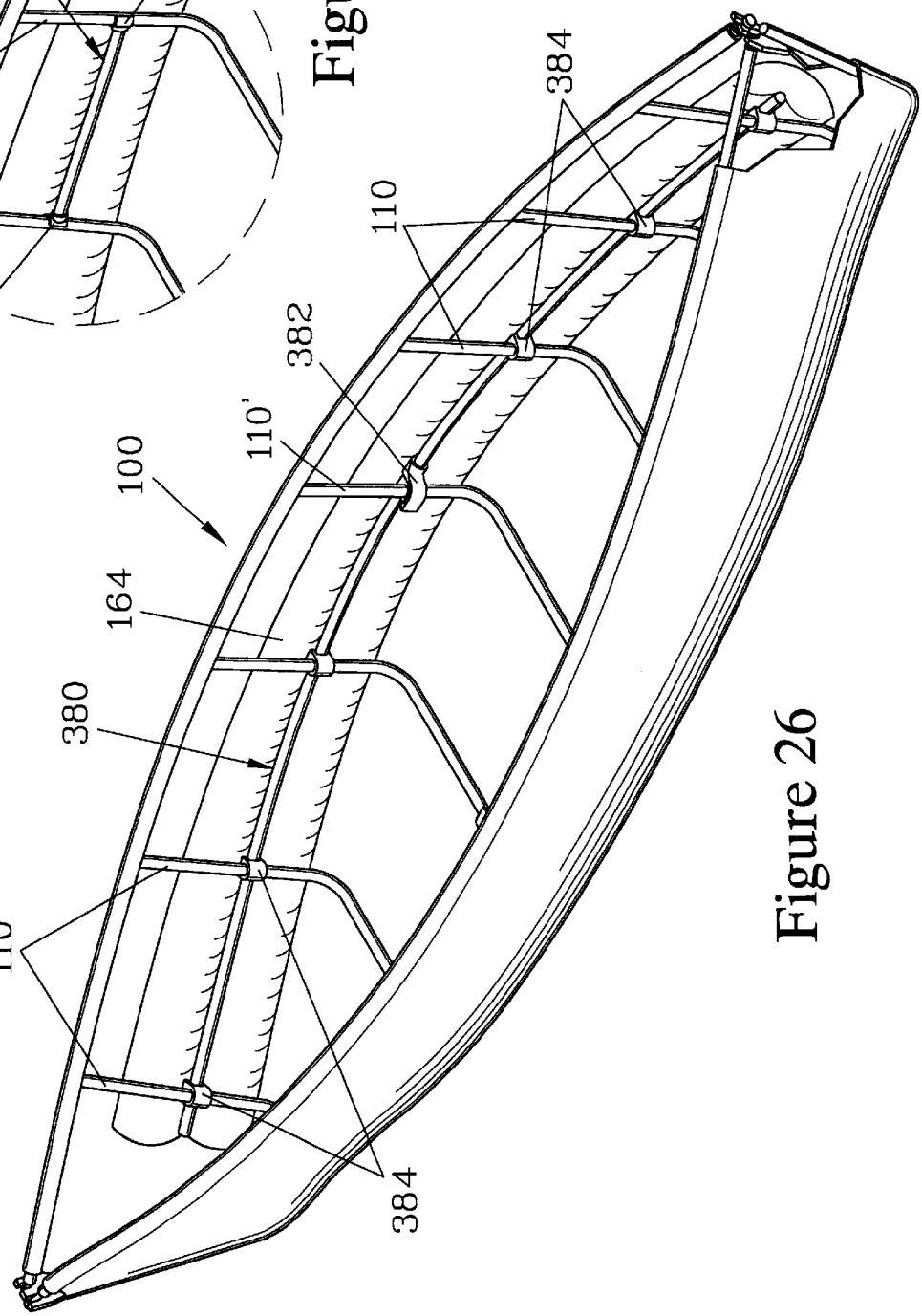
FIG. 26 is an isometric view illustrating a side stringer which can be employed in the embodiments shown in FIGS. 1, 15, and 20 to provide increased internal space by limiting the expansion of an inflatable compartment. The side stringer is secured to a central one of the ribs by a rib-engaging clip, and is positioned with respect to the remaining ribs by guide clips.

As discussed earlier, the collapsible boat 100 employs a pair of inflatable compartments 164 to increase longitudinal rigidity. It has been found that the inflatable compartments 164 tend to billow in the spaces between the ribs 110, reducing the internal space in the collapsible boat 100. FIG. 26 illustrates a side stringer 380, one of which can be employed on each side of the collapsible boat 100 to limit the expansion of the inflatable compartments 164 (only one of which is shown). The side stringer 380 is preferably secured to one of the ribs 110, such as the central rib 110', by a rib-engaging clip 382. The rib-engaging clip 382 can be essentially similar to the rib-engaging clips 124 on the keel stringer 114 (shown in FIGS. 1, 5, and 20). The position of the side stringer 380 is further maintained by guide clips 384 attached to the ribs 110. The guide clips 384 are affixed to the ribs 110 and are configured to cradle the side stringer 380. The side stringer 380 is held against the guide clips 384 by pressure from the inflatable compartment 164, and limits the ability of the inflatable compartment 164 to expand into the spaces between the ribs 110.

Figure 27:
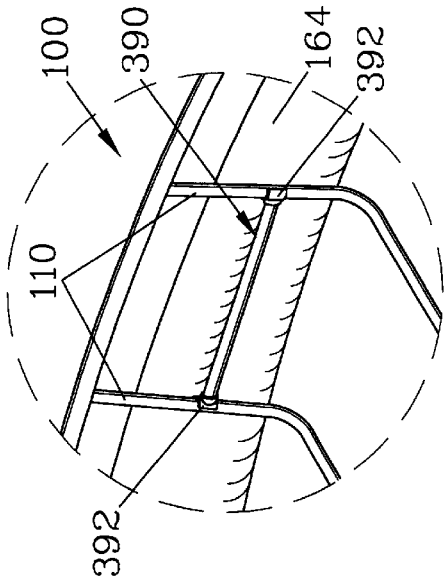
FIG. 27 illustrates a side rod which can be selectively connected between an adjacent pair of ribs to provide a localized increase in internal space by limiting the expansion of an inflatable compartment.

While the side stringer 380 increases internal space, it does so at the expense of increased complication in the assembly and disassembly of the collapsible boat 100. Frequently, a user will only require increased space in a section of the collapsible boat 100 to accommodate the desired stowage. FIG. 27 illustrates a side rod 390 which can be selectively connected between an adjacent pair of the ribs 110 to provide a localized increase in internal space. The side rod 390 terminates at rib-engaging clips 392, which can be essentially similar to the gunwale-engaging clips 112 of the ribs 110. When attached to a pair of the ribs 110 by the rib-engaging clips 392, the side rod 390 limits the expansion of the inflatable compartment 164 between that particular pair of ribs 110. The side rod 390 is preferably employed in pairs, with one on each side of the collapsible boat 100. If the ribs 110 are evenly spaced, the side rod 390 can be placed between a pair of ribs at whatever location increased internal space is desired.

For the comfort of the user, it is preferred to have a boat seat which is supported with respect to the bottom panel of the hull skin. Examples of boat seats which might be employed are found in U.S. Pat. Nos. 5,826,532 and 5,868,096 of the present inventor. These boat seats are especially well suited to use of the collapsible boat as a canoe, where the user is supported in a position substantially elevated above the bottom panel.

Figure 28:
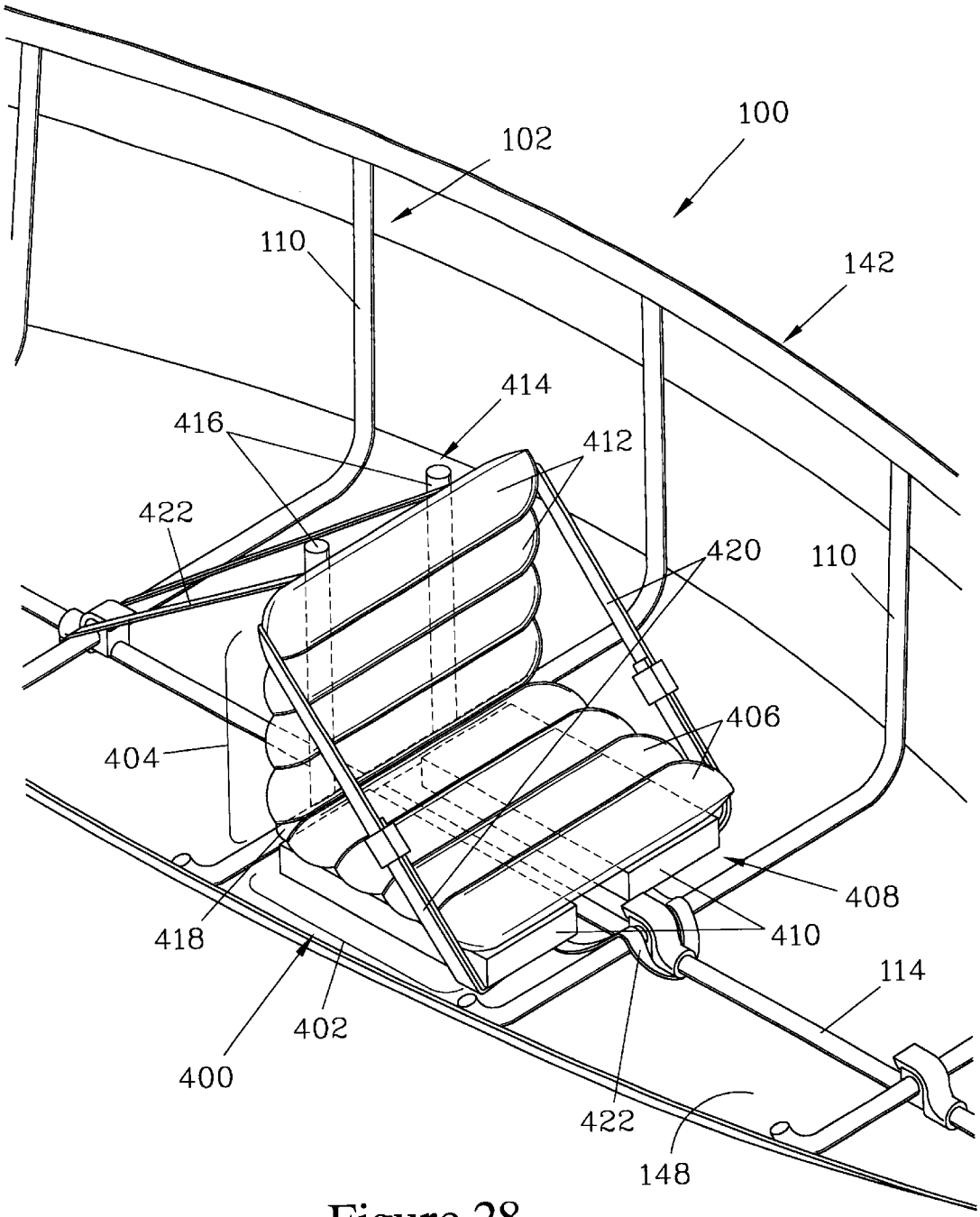
FIG. 28 is a view of a boat seat which can be employed in the embodiments shown in FIGS. 1, 15, and 20.

FIG. 28 illustrates a boat seat 400, which is shown installed in the collapsible boat 100 (which is partly cut away for clarity) and which particularly well suited for supporting the user in close proximity to the bottom panel 148 of the hull skin 142. It should be appreciated that the boat seat 400 can also be employed in any of the collapsible boat 200, the collapsible boat 200', the collapsible kayak 300, or the collapsible kayak 300' discussed above to provide greater comfort for the user.

The boat seat 400 has a seat portion 402 and a back portion 404. The seat portion 402 has a first series of inflatable chambers 406 attached to a seat support structure 408. The seat support structure 408 provides longitudinal rigidity to the seat portion 402, and is preferably formed by a pair of foam pads 410 which rest on the bottom panel 148 of the hull skin 142. The foam pads 410 preferably have a thickness of about 1 inch (25 mm) and are preferably formed of a semi-rigid, closed-cell foam having a density of about 2 lbs./cu. ft.

The back portion 404 of the boat seat 400 has a second series of inflatable chambers 412 attached to a back support structure 414. The back support structure 414 provides longitudinal rigidity to the back portion 404, and is preferably formed by a pair of back support members 416, which are preferably formed of tubing similar to that employed for the frame 102.

The seat portion 402 and the back portion 404 are connected together by a fabric hinge 418, which is preferably formed integrally with the first series of inflatable chambers 406 and the second series of inflatable chambers 412. Side straps 420 are provided on either side of the boat seat 400 and attach to both the seat portion 402 and the back portion 404 at locations spaced apart from the fabric hinge 418. The lengths of the side straps 420 are adjustable to allow the user to adjustably limit the rotation of the back portion 404 relative to the seat portion 402.

The boat seat 400 is attached with respect to one or more of the ribs 110 of the frame 102 to maintain the longitudinal position of the boat seat 400. Preferably, the boat seat 400 has at least one seat anchor strap 422 which passes around one of the ribs 110 and/or the keel stringer 114 to secure the boat seat 400 to the frame 102. Preferably, the seat anchor strap 422 is formed by extensions of the side straps 420. The boat seat 400 preferably attaches to two of the ribs 110 with two seat anchor straps 422 which are adjustable to allow the longitudinal position of the boat seat 400 to be adjusted. This enables the user to position the boat seat 400 with respect to the frame 102 such that one of the ribs 110 is properly positioned for bracing the feet of the user to facilitate control and handling of the collapsible boat 100 by the user.

While the novel features of the present invention have been described in terms of particular embodiments and preferred applications, it should be appreciated by one skilled in the art that substitution of materials and modification of details obviously can be made without departing from the spirit of the invention.

What I claim is:

1. A collapsible boat comprising:

a frame having, a pair of gunwales, each having a gunwale first end and a gunwale second end, a series of ribs connectable to said pair of gunwales by gunwale-engaging clips, a keel stringer attachable to said series of ribs and terminating in a first stem element, having a first stem element end, and a second stem element, having a second stem element end, a first end connector on said gunwale first end of each of said gunwales, each of said first end connectors being engagable with said first stem element end;

a hull skin having, a pair of gunwale sleeves, each of which slidably engages one of said pair of gunwales, a pair of side panels which attach to said pair of gunwale sleeves, a bottom panel attached to said pair of side panels, said pair of side panels and said bottom panel being configured to secure said pair of side panels with respect to each other;

means for securing said gunwale second ends with respect to said second stem element end; and means for longitudinally tensioning said hull skin with respect to said frame, thereby securing each of said first end connectors to said first stem element end.

2. The collapsible boat of claim 1 wherein said means for securing said gunwale second ends with respect to said second stem element end further comprises:

a second end connector on said second end of each of said gunwales, each of said second end connectors being engagable with said second stem element end, wherein said means for longitudinally tensioning said hull skin with respect to said frame acts to secure each of said second end connectors to said second stem element end.

3. The collapsible boat of claim 2 wherein each of said first end connectors engages said first stem element end so as to be readily engagable and disengagable therewith in an upwards direction, but is supportably engaged by said first stem element end to limit downwards motion of said first end connector, and further wherein each of said second end connectors engages said second stem element end so as to be readily engagable and disengagable therewith in an upwards direction, but is supportably engaged by said second stem element end to limit downwards motion of said second end connector.

4. The collapsible boat of claim 1 wherein said first stem element end further comprises:

a first bracket, said first end connectors each being connectable to said first bracket.

5. The collapsible boat of claim 4 wherein said first bracket is configured to be engaged by said first gunwale ends to allow said first gunwale ends to serve as said first end connectors.

6. The collapsible boat of claim 1 wherein said first stem element end further comprises:

an opening in said first stem element end, said first end connectors each being insertable into said opening.

7. The collapsible boat of claim 1 wherein said means for securing said gunwale second ends with respect to said second stem element end further comprises:

a closed sleeve end on each of said gunwale sleeves, said closed sleeve ends being positioned to limit said slidable engagement between said gunwale sleeves and said gunwales so as to stop said gunwales when said gunwale second ends are positioned in close proximity to said second stem element end; and means associated with said hull skin for securing said gunwale second ends together and preventing upwards motion of said second stem element end.

8. The collapsible boat of claim 7 wherein said means associated with said hull skin for securing said gunwale second ends together and preventing upwards motion of said second stem element end further comprises:

a cross strap attached to said hull skin and extending over said gunwale sleeves in the vicinity of said closed sleeve ends, said cross strap securing said gunwale second ends together when said gunwale second ends are positioned at said closed sleeve ends of said gunwale sleeves, said closed sleeve ends of said gunwale sleeves being so positioned as to position said gunwale second ends with respect to said hull skin such as to reside above said second stem element end such that upwards motion of said second stem element end is restrained by said gunwale second ends.

9. The collapsible boat of claim 7 wherein said means associated with said hull skin for securing said gunwale second ends together and preventing upwards motion of said second stem element end further comprises:

a fold in said hull skin in close proximity to said closed sleeve ends of said gunwale sleeves, said fold being positioned above said second stem element end; and a fastener securing said fold in said hull skin together to form a pocket into which said second stem element end seats.

10. The collapsible boat of claim 7 wherein each of said first end connectors engages said first stem element end so as to be readily engagable and disengagable therewith in an upwards direction, but is supportably engaged by said first stem element end to limit downwards motion of said first end connector.

11. The collapsible boat of claim 1 wherein said means for longitudinally tensioning said hull skin with respect to said frame is provided by a central joint on said keel stringer in combination with means for lockably engaging said keel stringer with several of said ribs, said central joint allowing said keel stringer to be adjusted between a bent configuration, where said keel stringer has a substantially reduced length, and a substantially straight configuration, where said keel stringer extends the length of straight and is centrally located in the collapsible boat, and said means for lockably engaging said keel stringer with several of said ribs allowing said keel stringer to be moved from substantially straight configuration to a straight configuration, where said keel stringer extends straight and is centrally located in the collapsible boat, said keel stringer being maintained straight by said lockable engagement with said ribs.

12. The collapsible boat of claim 1 further comprising:

a first deck support member attachable to said frame so as to extend parallel to said series of ribs;

a first deck stringer having a first deck stringer inner end region, which is configured to engage said first deck support member, and a first deck stringer outer end region, which is configured to reside above said gunwale first ends;

means associated with said hull skin for securing said first deck stringer outer end region with respect to said gunwale first ends;

a second deck support member attachable to said frame so as to extend parallel to said series of ribs and said first deck support member;

a second deck stringer having a second deck stringer inner end region, which is configured to engage said second deck support member, and a second deck stringer outer end region, which is configured to reside above said gunwale second ends;

means associated with said hull skin for securing said second deck stringer outer end region with respect to said gunwale second ends; and a deck skin attachable to said hull skin so as to overly said first deck support member, said second deck support member, said first deck stringer, and said second deck stringer, said deck skin having a cockpit opening therein.

13. The collapsible boat of claim 12 wherein said means for securing said first deck stringer outer end region further comprises:

a first hull skin extension which extends over said first deck stringer outer end region; and a first support strap attached to said first hull skin extension and attached with respect to said first deck support member to secure said first hull skin extension over said first deck stringer outer end region to secure said first deck stringer outer end region with respect to said gunwale first ends; and further wherein said means for securing said second deck stringer outer end region further comprises:

a second hull skin extension which extends over said second deck stringer outer end region; and a second support strap attached to said hull skin and extending over said second deck stringer outer end region to secure said second deck stringer outer end region with respect to said gunwale second ends.

14. The collapsible boat of claim 13 wherein said deck skin further comprises:

a coaming sleeve surrounding said cockpit opening; and a tubular coaming member retained in said coaming sleeve.

15. The collapsible boat of claim 14 wherein said tubular coaming member further comprises:

a coaming member first half formed of aluminum tubing;

a coaming member second half formed of aluminum tubing; and an elastic hinge member connecting said coaming member first half to said coaming member second half.

16. The collapsible boat of claim 15 wherein said coaming sleeve is formed of an elastic fabric.

17. A collapsible boat comprising:

a frame having, a pair of gunwales, each having a gunwale first end and a gunwale second end, a series of ribs connectable to said pair of gunwales by gunwale-engaging clips, a keel stringer attachable to said series of ribs and terminating in a first stem element, having a first stem element end, and a second stem element, having a second stem element end, means for securing said gunwale first ends with respect to said first stem element end;

a hull skin having, a pair of gunwale sleeves, each of which slidably engages one of said pair of gunwales, said gunwale sleeves each having a closed sleeve end, said closed sleeve ends being positioned to limit longitudinal positioning of said gunwales with respect to said gunwale sleeves by engaging said gunwales when said gunwale second ends are positioned in close proximity to said second stem element end;

a pair of side panels which attach to said pair of gunwale sleeves, a bottom panel attached to said pair of side panels, said pair of side panels and said bottom panel being configured to secure said pair of side panels with respect to each other;

means associated with said hull skin for securing said gunwale second ends together and preventing upwards motion of said second stem element end; and means for longitudinally tensioning said hull skin with respect to said frame.

18. The collapsible boat of claim 17 wherein said means associated with said hull skin for securing said gunwale second ends together and preventing upwards motion of said second stem element end further comprises:

a cross strap attached to said hull skin and extending over said gunwale sleeves in the vicinity of said closed sleeve ends, said cross strap securing said gunwale second ends together when said gunwale second ends are positioned at said closed sleeve ends of said gunwale sleeves, said closed sleeve ends of said gunwale sleeves being so positioned as to position said gunwale second ends with respect to said hull skin such as to reside above said second stem element end such that upwards motion of said second stem element end is restrained by said gunwale second ends.

19. The collapsible boat of claim 17 wherein said means associated with said hull skin for securing said gunwale second ends together and preventing upwards motion of said second stem element end further comprises:

a fold in said hull skin in close proximity to said closed sleeve ends of said gunwale sleeves, said fold being positioned above said second stem element end; and a fastener securing said fold in said hull skin together to form a pocket into which said second stem element end seats.

20. The collapsible boat of claim 17 wherein said closed sleeve ends of said gunwale sleeves are openable so as to allow slidable engagement between said gunwale sleeves and said gunwales when said closed sleeve ends are opened.

21. The collapsible boat of claim 20 wherein said closed sleeve ends of said gunwale sleeves each further comprises:

a closure strap having a fixed end affixed with respect to said gunwale sleeve and a free end having a strap fastening element thereon; and a sleeve fastening element on said gunwale sleeve designed to attachably mate with said strap fastening element, said sleeve fastening element being positioned on said gunwale sleeve such that, when said strap fastening element is attached thereto to close said closed sleeve end, said closure strap passes over said gunwale second end so as to limit longitudinal positioning of said gunwale sleeve with respect to said gunwale sleeve in which said gunwale resides.

22. A collapsible boat comprising:

a frame having, a pair of gunwales, each having a gunwale first end and a gunwale second end, a series of ribs connectable to said pair of gunwales by gunwale-engaging clips, a keel stringer which is lockably engagable with said series of ribs and which terminates in a first stem element, having a first stem element end, and a second stem element, having a second stem element end, said keel stringer having a central joint which is spaced apart from said first stem element and from said second stem element, said central joint allowing said keel stringer to be adjusted between a bent configuration, where said keel stringer has a substantially reduced length, and a substantially straight configuration, where said keel stringer extends the length of the collapsible boat, said lockable engagement of said keel stringer with said series of ribs allowing said keel stringer to be moved from said substantially straight configuration to a straight configuration, where said keel stringer extends straight and is centrally located in the collapsible boat, said keel stringer being maintained in said straight configuration by said lockable engagement with said series of ribs;

a hull skin having, a pair of gunwale sleeves, each of which slidably engages one of said pair of gunwales, a pair of side panels which attach to said pair of gunwale sleeves, a bottom panel attached to said pair of side panels, said pair of side panels and said bottom panel being configured to secure said pair of side panels with respect to each other;

means for securing said gunwale first ends with respect to said first stem element end; and means for securing said gunwale second ends with respect to said second stem element end;

wherein said frame and said hull skin are sized such that movement of said keel stringer from said bent configuration to said substantially straight configuration and from said substantially straight configuration to said straight configuration increases the effective length of said keel stringer so as to bring said frame into forcible engagement with said hull skin.

* * * * *